US008481467B2

(12) United States Patent
Yagishita et al.

(10) Patent No.: US 8,481,467 B2
(45) Date of Patent: Jul. 9, 2013

(54) LUBRICATING OIL ADDITIVE AND LUBRICATING OIL COMPOSITION

(75) Inventors: Kazuhiro Yagishita, Yokohama (JP); Shouzaburou Konishi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 1823 days.

(21) Appl. No.: 11/279,796

(22) Filed: Apr. 14, 2006

(65) Prior Publication Data

US 2006/0172900 A1 Aug. 3, 2006

Related U.S. Application Data

(63) Continuation of application No. PCT/JP2004/015670, filed on Oct. 15, 2004.

(30) Foreign Application Priority Data

| | | |
|---|---|---|
| Oct. 16, 2003 | (JP) | 2003-357089 |
| Oct. 16, 2003 | (JP) | 2003-357090 |
| Oct. 16, 2003 | (JP) | 2003-357091 |
| Oct. 16, 2003 | (JP) | 2003-357092 |
| Oct. 16, 2003 | (JP) | 2003-357093 |
| Oct. 16, 2003 | (JP) | 2003-357094 |
| Oct. 16, 2003 | (JP) | 2003-357095 |
| Oct. 16, 2003 | (JP) | 2003-357096 |
| Mar. 22, 2004 | (JP) | 2004-082194 |

(51) Int. Cl.
*C10M 133/02* (2006.01)

(52) U.S. Cl.
USPC ..... 508/546; 508/545; 508/547; 508/556

(58) Field of Classification Search
USPC ..... 508/545, 546, 547, 556
See application file for complete search history.

(56) References Cited

U.S. PATENT DOCUMENTS

| | | | | |
|---|---|---|---|---|
| 2,328,190 | A | 8/1943 | Burk et al. | |
| 2,658,062 | A | 11/1953 | Jones | |
| 3,677,726 | A | 7/1972 | Coran | |
| 3,706,667 | A | 12/1972 | Coran | |
| 3,773,722 | A | 11/1973 | Dexter | |
| 4,158,633 | A * | 6/1979 | Papay | 508/372 |
| 4,328,113 | A * | 5/1982 | Horodysky et al. | 508/189 |
| 4,358,611 | A | 11/1982 | Pilgram | |
| 4,439,612 | A | 3/1984 | Babic | |
| 4,521,325 | A * | 6/1985 | Sandel | 252/77 |
| 4,919,833 | A | 4/1990 | Miles | |
| 5,032,309 | A * | 7/1991 | Miles | 252/77 |
| 5,789,358 | A * | 8/1998 | Berlowitz et al. | 508/552 |
| 6,070,561 | A * | 6/2000 | Greene et al. | 123/90.36 |
| 6,187,726 | B1 | 2/2001 | Nalesnik et al. | |
| 6,303,547 | B1 | 10/2001 | Balasubramaniam | |
| 6,638,897 | B2 * | 10/2003 | Ogano et al. | 508/192 |
| 2002/0055440 | A1 | 5/2002 | Balasubramaniam | |
| 2002/0142922 | A1 | 10/2002 | Yagishita et al. | |
| 2002/0169217 | A1 | 11/2002 | Ebbrecht et al. | |
| 2003/0008785 | A1 * | 1/2003 | Nalesnik | 508/376 |
| 2004/0220059 | A1 * | 11/2004 | Esche | 508/291 |
| 2005/0143266 | A1 | 6/2005 | Yagishita | |

FOREIGN PATENT DOCUMENTS

| | | | |
|---|---|---|---|
| EP | 1 439 217 | A1 | 7/2004 |
| GB | 570951 | A | 7/1945 |
| JP | 47-4276 | A | 3/1972 |
| JP | 50-121175 | A | 9/1975 |
| JP | 60-146862 | A | 8/1985 |
| JP | 63-308096 | A | 12/1988 |
| JP | 06-10164 | A | 1/1994 |
| JP | 2002-129184 | A | 5/2002 |
| JP | 2002-294271 | A | 10/2002 |
| JP | 2004-083751 | A | 3/2004 |
| WO | WO 02/099017 | A1 | 12/2002 |
| WO | WO 03/033629 | A1 | 4/2003 |

OTHER PUBLICATIONS

EP Search Report issued May 31, 2011 in EP Application No. 11001549.2; Written Opinion.

EP Search Report issued May 31, 2011 in EP Application No. 11001550.0; Written Opinion.

Supplemental European Search Report from the European Patent Office dated Mar. 29, 2010 in counterpart application EP 04 79 2812.

* cited by examiner

*Primary Examiner* — Jim Goloboy

(74) *Attorney, Agent, or Firm* — Panitch Schwarze Belisario & Nadel LLP

(57) ABSTRACT

Lubricating oil compositions have low friction properties and anti-wear properties and are excellent in long drain capability. The lubricating oil compositions are particularly suitable for use as a fuel efficient type lubricating oil for internal combustion engines. The lubricating oil compositions contain a lubricating oil additive comprising one or more compounds selected from a specific nitrogen-containing compound, an acid-modified derivative thereof, and an oil soluble metal complex obtained by mixing the nitrogen-containing compound and/or acid-modified derivative thereof with an organic metal salt and/or organic metal complex.

14 Claims, No Drawings

LUBRICATING OIL ADDITIVE AND LUBRICATING OIL COMPOSITION

CROSS-REFERENCE TO RELATED APPLICATION

This application is a continuation of International Application No. PCT/JP2004/015670, filed Oct. 15, 2004, which was published in the Japanese language on Apr. 28, 2005, under International Publication No. WO 2005/037967 A1 and the disclosure of which is incorporated herein by reference.

FIELD OF THE INVENTION

The present invention relates to lubricating oil additives and lubricating oil compositions, and particularly to a long drain lubricating oil composition with low friction properties and anti-wear properties, suitable as a fuel efficient lubricating oil for internal combustion engines.

BACKGROUND OF THE INVENTION

Lubricants have been used in internal combustion engines, automatic transmissions or bearings such that they move easily and smoothly. Particularly, lubricating oils for internal combustion engines, i.e., engine oils are required to possess high degree of performances due to higher performances and higher output power of recent internal combustion engines than ever and severe conditions where they run. Therefore, conventional engine oils are blended with various additives such as anti-wear agents, metallic detergents, ashless dispersants, and antioxidants so as to satisfy such requirements. Since the use of such conventional engine oils increases the energy loss due to the friction occurring at some parts of an engine where the oils work, there have been also used fuel efficient lubricating oils containing friction modifiers for reducing the friction loss and fuel consumption. The friction modifiers include oil soluble metallic friction modifiers containing a metal element such as molybdenum and ashless friction modifiers leaving no ash even though it burns. The molybdenum-based friction modifiers are excellent in friction reducing effect when they are fresh but are limited in maintaining the effect for a long period of time with conventional techniques. The molybdenum-based friction modifiers are demanded to be decreased because they adversely affects the exhaust gas purifying device of an internal combustion engine and molybdenum can be an element hindering the recycle of lubricating oils containing the friction modifiers. Whereas, ashless friction modifiers, such as ester-, amine-, or amide-based friction modifiers are free from such drawbacks and have increased in their importance from the viewpoint of environment protection. However, the ashless friction modifiers are much poorer in the friction reducing effect when they are fresh, than the molybdenum-based friction modifiers and thus have been demanded to be improved in the performance capability.

Furthermore, from the view point of recent environmental issues, lubricating oils have been demanded to be improved in the long-drain capability to extend the drain intervals. It is now found that zinc dialkyldithiophosphate (ZDTP) which has been used suitably as an anti-wear agent and an antioxidant is not suitable with the objective of oxidation stability and hydrolytic stability under the recent situations where a further improvement in long drain capability is highly demanded.

The inventors of the present invention discovered that lubricating oil compositions containing less or no ZDTP having been used for many years and containing a specific phosphorus compound was able to exhibit extremely excellent long drain capability (oxidation stability, base number retention properties, and thermal stability) and low friction properties while maintaining anti-wear properties equivalent to those of a lubricating oil containing zinc dithiophosphate and has already filed patent applications for these compositions (Japanese Patent Laid-Open Publication Nos. 2002-29427.1 and 2004-83751).

It was confirmed that when these lubricating oil compositions containing a specific phosphorus compound were optimally blended with other additives, they exhibited anti-wear properties determined by a valve train wear test conducted for domestic engines typically as described in JASO M328-95, equivalent to the anti-wear properties of a composition containing ZDTP. However, a lubricating oil is required to possess extreme pressure properties and anti-wear properties more excellent than ever so as to be used in a special engine driven under more severe conditions or used under particular circumstances where more excellent extreme pressure properties and anti-wear properties are required; or to fulfill a requirement that the phosphorus content is decreased to 0.08% by mass or less to meet the suitableness for an exhaust-gas purifying catalyst in the forthcoming ILSAC GF-4 standard or another requirement of low phosphorus content that the phosphorus content is decreased to 0.05% by mass or less to be sought in ILSAC GF-5 standard which is a plan under consideration. The lubricating oil is demanded to be further improved in the low friction properties.

However, it is difficult to decrease the phosphorus content of a lubricating oil containing an organic molybdenum compound with excellent extreme pressure properties and low friction properties because the compound generally contains phosphorus and/or sulfur. It is also difficult to decrease the phosphorus content of a lubricating oil with the use of a sulfur-free phosphorus compound because the extreme pressure properties and anti-wear properties are deteriorated if the phosphorus content is simply decreased. Alternatively, an increase in the amount of a sulfur-containing compound or of a metal-containing compound adversely affects an exhaust-gas after-treatment device, i.e., fails to solve the problems that an exhaust-gas purifying catalyst such as a ternary catalyst, an oxidation catalyst and a NOx adsorber and a DPF or an exhaust-gas treatment system which is the combination of a DPF with the exhaust-gas purifying catalyst, particularly the oxidation catalyst or NOx adsorber undergo to catalyst poisoning and/or clogging of the DPF caused by the increased sulfur and metal. Furthermore, the lubricating oil will be extremely deteriorated in oxidation stability, base number retention properties and detergency due to the increase in the amount of sulfur and metal.

Therefore, it has been very difficult to produce a lubricating oil which has both anti-wear properties and low friction properties and can be decreased in phosphorus and sulfur contents or additionally ash content while maintaining excellent long-drain capability. A solution of such problems has been demanded.

As described above, ZDTP has been used as an anti-wear agent necessarily in an engine oil but has been demanded to be added in a less amount because it adversely affects an exhaust gas purifying catalyst such as a ternary catalyst for an internal combustion engine and can be an element disturbing the recycle of a lubricating oil. There is disclosed a method wherein deterioration of anti-wear properties caused by decreasing ZDTP is compensated using a hydrazide derivative as an anti-wear agent which does not adversely affect an exhaust gas purifying catalyst (see International Publication Pamphlet No. 02/99017).

However, because hydrazides are relatively high in melting point and insoluble or sparingly soluble in oil at room temperature, it is necessary to maintain the hydrazides at a temperature equal to or higher than the melting point thereof and spend a long time in order to dissolve the hydrazides. However, these hydrazide compounds are precipitated when exposed to a low temperature even though they are once dissolved. It is thus difficult to use the hydrazide compounds in a lubricating oil used from low temperatures to high temperatures. It was found that a technique to render the hydrazide compounds oil soluble at low temperature is needed.

It was also found that when a lubricating oil composition containing hydrazides was blended with a conventional level of zinc dithiophosphate, it is less effective in reducing friction and was still able to be improved.

It was also found that a lubricating oil composition containing hydrazides was still able to be improved in high-temperature detergency, capability to prevent copper from eluting from members or parts made of copper of an engine, and anti-wear properties against valve-train wear when the composition is used as a 0W-20 ultra fuel efficient engine oil, a low phosphorus engine oil (the phosphorus content is 0.08% by mass or less), or a sulfur-free long drain engine oil.

Disclosure of the Invention

In view of the above-described situations, an object of the present invention is to provide a lubricating oil additive with excellent low friction properties, in the place of an organic molybdenum compound containing sulfur and metal; a lubricating oil additive composition containing such an additive; and a low phosphorus and sulfur lubricating oil composition containing such an additive or additive composition, which is improved in friction reducing properties and anti-wear properties while maintaining long drain capability at an extremely high level and is suitable for an internal combustion engine.

The present invention also provides a technique to render hydrazides which are insoluble or sparingly oil soluble at relatively low temperatures, oil soluble even at relatively low temperatures thereby providing techniques to improve the handling of a lubricating oil additive or composition containing such hydrazides which are solid at ordinary temperature during the process of manufacture thereof, to shorten the manufacturing time, or dissolve hydrazides stably in the additive or composition so as to improve the storage stability thereof.

Another object of the present invention is to provide a lubricating oil composition with improved low friction properties even though it contains a hydrazide derivative is used.

Another object of the present invention is to provide a lubricating oil additive containing a hydrazide derivative which is excellent in a capability to prevent copper elution and anti-wear properties for valve trains and a lubricating oil composition containing such an additive.

As a result of extensive study and research by the inventors of the present invention, the present invention was achieved based on the finding that the above objects were able to be achieved with a lubricating oil additive containing one or more compounds selected from the group consisting of specific nitrogen-containing compounds, acid-modified derivatives thereof, and oil soluble metal complexes obtained by mixing the nitrogen-containing compounds and/or the acid-modified derivatives thereof with an organic metal salt and/or an organic metal complex; a lubricating oil composition containing such an additive; and a lubricating oil composition containing such an additive and further a specific phosphorus compound in combination.

That is, according to a first aspect of the present invention, there is provided a lubricating oil additive comprising (A) one or more compounds selected from the group consisting of nitrogen-containing compounds represented by formula (1) below, acid-modified derivatives thereof, and oil soluble metal complexes obtained by mixing the nitrogen-containing compounds and/or the acid-modified derivatives thereof with an organic metal salt and/or an organic metal complex:

(1)

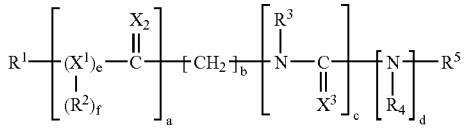

wherein $R^1$ is a hydrocarbon or functionalized hydrocarbon group having 1 to 30 carbon atoms, $R^2$ through $R^5$ are each independently hydrogen or a hydrocarbon or functionalized hydrocarbon group having 1 to 30 carbon atoms, $X^1$ is selected from oxygen, sulfur, and nitrogen, $X^2$ and $X^3$ are each independently oxygen or sulfur, a, b and f are each independently an integer of 0 or 1, c is an integer of 0 or 1 or greater, d is an integer of 1 or 2, and e is an integer of 0 to 2.

According to a second aspect of the present invention, there is provided the lubricating oil additive according to the first aspect wherein Component (A) is one or more compounds selected from the group consisting of the following (A-1) through (A-6) components:

(A-1) at least one kind of compound selected from the group consisting of nitrogen-containing compounds represented by formula (2) below and acid-modified derivatives thereof, (2)

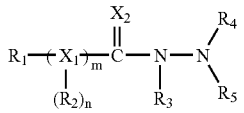

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 10 carbon atoms or hydrogen, $X_1$ is selected from oxygen, nitrogen, and sulfur, $X_2$ is oxygen or sulfur, m is an integer of 1 or 2, and n is an integer of 0 or 1;

(A-2) at least one kind of compound selected from the group consisting of nitrogen-containing compounds represented by formula (3) below and acid-modified derivatives thereof, (3)

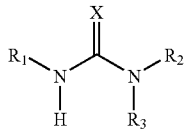

wherein $R_1$ is a hydrocarbon or functionalized hydrocarbon group having 1 to 30 carbon atoms, $R_2$ and $R_3$ are each independently a hydrocarbon or functionalized hydrocarbon group having 1 to 30 carbon atoms or hydrogen, X is oxygen or sulfur;

(A-3) at least one kind of compound selected from the group consisting of nitrogen-containing compounds represented by formula (4) below and acid-modified derivatives thereof, (4)

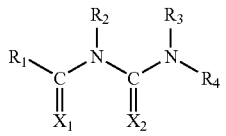

wherein $R_1$ is a hydrocarbon or functionalized hydrocarbon group having 1 to 30 carbon atoms, $R_2$ through $R_4$ are each independently a hydrocarbon or functionalized hydrocarbon group having 1 to 30 carbon atoms or hydrogen, and $X_1$ and $X_2$ are each independently oxygen or sulfur;

(A-4) at least one kind of compound selected from the group consisting of nitrogen-containing compounds represented by formula (5) below and acid-modified derivatives thereof, (5)

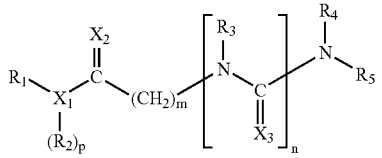

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 30 carbon atoms or hydrogen, $X_1$ is oxygen or nitrogen, $X_2$ and $X_3$ are each independently oxygen or sulfur, p is an integer of 0 or 1, m is an integer of 0 or 1, and n is an integer of 1 or greater;

(A-5) hydrazide derivative obtained by modifying nitrogen-containing compounds represented by formula (6) below with acid or a salt of thereof (6)

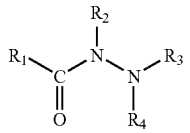

wherein $R_1$ is a hydrocarbon group having 1 to 30 carbon atoms or a functionalized substituent having 1 to 30 carbon atoms, and $R_2$ through $R_4$ are each independently a hydrocarbon group having 1 to 30 carbon atoms, a functionalized substituent having 1 to 30 carbon atoms, or hydrogen; and (A-6) oil soluble metal complexes obtained by mixing at least one kind of compound selected from the group consisting of Components (A-1) through (A-5) and nitrogen-containing compounds represented by formula (7) below with an organic metal salt and/or an organic metal complex (7)

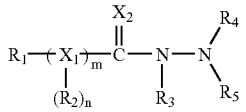

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 30 carbon atoms or hydrogen, $X_1$ is selected from oxygen, nitrogen and sulfur, $X_2$ is oxygen or sulfur, m is an integer of 0 to 2, and n is an integer of 0 or 1.

According to a third aspect of the present invention, there is provided the lubricating oil additive according to the first or second aspect which further comprises a derivative obtained by modifying any of the foregoing nitrogen-containing compounds with boric acid or a salt thereof.

According to a fourth aspect of the present invention, there is provided a lubricating oil additive composition obtained by blending the lubricating oil additive according to the second or third aspect with at least one kind selected from lubricating base oils, ashless dispersants, antioxidants, friction modifiers, anti-wear agents, viscosity index improvers, corrosion inhibitors, rust inhibitors, demulsifiers, metal deactivators, anti-foaming agents, seal swelling agents, and dyes.

According to a fifth aspect of the present invention, there is provided a lubricating oil composition obtained by blending a lubricating base oil with the lubricating additive according to the first to third aspects or the lubricating oil additive composition according to the fourth aspect.

According to a sixth aspect of the present invention, there is provided the lubricating oil composition according to the fifth aspect blended with (B) a metal-containing phosphorus compound.

According to a seventh aspect of the present invention, there is provided a lubricating oil composition obtained by blending a lubricating base oil, the lubricating oil additive according to any of the first to fourth aspects, and (C) a phosphorus compound other than zinc dithiophosphate.

According to an eighth aspect of the present invention, there is provided the lubricating oil composition according to the seventh aspect wherein the lubricating oil additive contains a nitrogen-containing compound represented by formula (6) above.

According to a ninth aspect of the present invention, there is provided the lubricating oil composition according to the seventh or eighth aspect wherein Component (C) is at least one kind of compound selected from the group consisting of (C-1) phosphorus compounds represented by formula (8) below and metal salts and amine salts thereof:

(8)

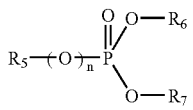

wherein $R_5$ is a hydrocarbon group which may contain oxygen and/or nitrogen, having 1 to 30 carbon atoms, $R_6$ and $R_7$ are each independently a hydrocarbon group which may contain oxygen and/or nitrogen, having 1 to 30 carbon atoms or hydrogen, and n is an integer of 0 or 1.

According to a tenth aspect of the present invention, there is provided the lubricating oil composition according to the seventh or eighth aspect wherein Component (C) is at least one kind of compound selected from the group consisting of (C-2) phosphorus compounds represented by formula (9) below and/or (C-3) metal salts of phosphorus compounds represented by formulas (10) and (11) below:

(9)

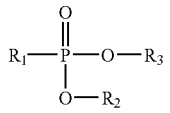

wherein $R_1$, $R_2$, and $R_3$ are each independently a hydrocarbon group which may contain nitrogen and/or oxygen, having 1 to 30 carbon atoms;

(10)

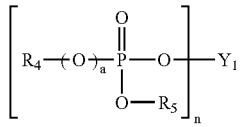

wherein $R_4$ and $R_5$ are each independently a hydrocarbon group which may contain nitrogen and/or oxygen, having 3 to 30 carbon atoms, $Y_1$ is a metal element, n is an integer corresponding to the valence of $Y_1$, and a is an integer of 0 or 1; and (11)

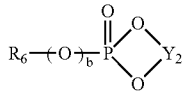

wherein $R_6$ is a hydrocarbon group which may contain nitrogen and/or oxygen, having 3 to 30 carbon atoms, $Y_2$ is a metal element, and b is an integer of 0 or 1.

According an eleventh aspect of the present invention, there is provided the lubricating oil composition according to any of the fifth to tenth aspect which further comprises at least one additive selected from the group consisting of ashless dispersants, antioxidants, friction modifiers, anti-wear agents other than a phosphorus compound, metallic detergents, viscosity index improvers, corrosion inhibitors, rust inhibitors, demulsifiers, metal deactivators, anti-foaming agents, seal swelling agents, and dyes.

According to a twelfth aspect of the present invention, there is provided the lubricating oil composition according to any of the fifth to eleventh aspects wherein the total aromatic content and sulfur content of the lubricating base oil are 3% by mass or less and 0.05% by mass or less, respectively.

According to a thirteenth aspect of the present invention, there is provided the lubricating oil composition according to any of the fifth to twelfth aspects wherein the sulfated ash content is 1% by mass or less.

According to a fourteenth aspect of the present invention, there is provided the lubricating oil composition according to any of the fifth to thirteenth aspects wherein the phosphorus content is 0.08% by mass or less based on the total mass of the composition.

According to a fifteenth aspect of the present invention, there is provided the lubricating oil composition according to the fifth to fourteenth aspects wherein the content of effective components contained in the sulfur-containing additive is 0.15% by mass or less in terms of sulfur based on the total mass of the composition.

According to a sixteenth aspect of the present invention, there is provided the lubricating oil composition according to any of the fifth to fifteenth aspects of the present invention which is used for an internal combustion engine.

According to a seventeenth aspect of the present invention, there is provided the lubricating oil composition according to the sixteenth aspect wherein the internal combustion engines uses a fuel whose sulfur content is 50 ppm by mass or less.

According to an eighteenth aspect of the present invention, there is provided the lubricating oil composition according to the sixteenth or seventeenth aspect wherein the internal combustion engine is equipped with a direct striking bucket type- or roller follower-type valve train system.

According to a nineteenth aspect of the present invention, there is provided the lubricating oil composition according to any of the sixteenth to eighteenth aspects wherein the internal combustion engine is equipped with an exhaust gas treatment system which is a combination of one or more kinds selected from the group consisting of a ternary catalyst, an oxidation catalyst, a NOx adsorber and a DPF.

Hereinafter, the present invention will be described in more detail.

The lubricating oil additive comprises (A) one or more nitrogen-containing compound selected from the group consisting of nitrogen-containing compounds represented by formula (1) below, acid-modified derivatives thereof, and oil soluble metal complexes obtained by mixing the nitrogen-containing compounds and/or the acid-modified derivatives thereof with an organic metal salt and/or an organic metal complex:

(1)

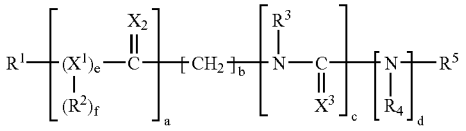

wherein $R^1$ is a hydrocarbon or functionalized hydrocarbon group having 1 to 30 carbon atoms, $R^2$ through $R^5$ are each independently hydrogen or a hydrocarbon or functionalized hydrocarbon group having 1 to 30 carbon atoms, $X^1$ is selected from oxygen, sulfur, and nitrogen, $X^2$ and $X^3$ are each independently oxygen or sulfur, a, b and f are each independently 0 or 1, c is an integer of 0 or 1 or greater, d is an integer of 1 or 2, and e is an integer of 0 to 2.

Component (A) is preferably one or more kinds selected from (A-1) at least one type of compound selected from the group consisting of nitrogen-containing compounds represented by formula (2) below and acid-modified derivative thereof; (A-2) at least one kind of compound selected from the group consisting of nitrogen-containing compounds represented by formula (3) below and acid-modified derivatives thereof; (A-3) at least one kind of compound selected from the group consisting of nitrogen-containing compounds represented by formula (4) below and acid-modified derivatives thereof; (A-4) at least one kind of compound selected from the group consisting of nitrogen-containing compounds represented by formula (5) below and acid-modified derivatives thereof; (A-5) a hydrazide derivative obtained by modifying nitrogen-containing compounds represented by formula (6) below with acid or a salt thereof; and (A-6) an oil soluble metal complex obtained by mixing at least one compound selected from the group consisting of Components (A-1) through (A-5) and nitrogen-containing compounds represented by formula (7) below with an organic metal salt and/or an organic metal complex.

Among Components (A), nitrogen-containing compounds represented by formula (1) wherein a is 1, b and c are each 0, d is 2, e is 0, and $X^2$ is oxygen, i.e., (A-7) nitrogen-containing compounds represented by formula (6) below are preferably acid-modified like Component (A-5) or formed into oil soluble metal complexes like Component (A-6) and used in combination with Component (C) described later.

Formulas (2) to (7) are as follows:

(2)

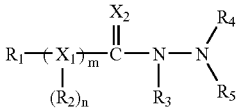

(3)

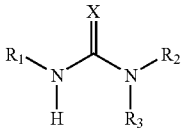

(4)

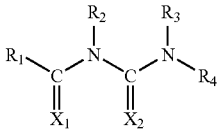

(5)

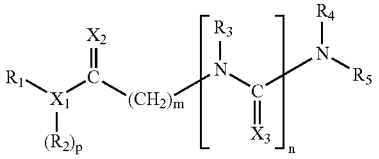

(6)

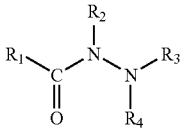

(7)

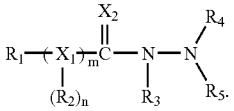

Compounds represented by formula (2) corresponds to compounds represented by formula (1) wherein a is 1, b is 0, c is 0, d is 2, e is 1 or 2, and f is 0 or 1. In formula (2), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, $R_2$ through $R_5$ are each independently a hydrocarbon or functionalized hydrocarbon group having 1 to 10 carbon atoms or hydrogen, preferably a hydrocarbon group having 1 to 4 carbon atoms or hydrogen, and more preferably hydrogen, $X_1$ is oxygen, nitrogen, or sulfur, preferably oxygen or nitrogen, and more preferably nitrogen, $X_2$ is oxygen or sulfur, preferably oxygen, m is an integer of 1 or 2, preferably 1, and n is an integer of 0 or 1, preferably 1.

Preferred examples of nitrogen-containing compounds represented by formula (2) wherein $X^1$ is nitrogen and $X^2$ is oxygen include carbazinamide (semicarbazide) derivatives and carbazide derivatives.

Specific examples of carbazinamide derivatives include those wherein $R_1$ is a hydrocarbon or functionalized hydrocarbon group having 1 to 30 carbon atoms, all of $R_2$ through $R_5$ are hydrogen, $X_1$ is nitrogen, m is 1, and n is 1; N-hydrocarbyl carbazinamide derivatives (hydrocarbyl denotes hydrocarbon group) wherein $R_1$ is a hydrocarbon or functionalized hydrocarbon group having 1 to 30 carbon atoms, $R_2$, $R_4$ and $R_5$ are each hydrogen, $R_3$ is a hydrocarbon or functionalized hydrocarbon group having 1 to 10 carbon atoms, $X_1$ is nitrogen, m is 1, and n is 1; carbazide derivatives wherein $R_1$ a hydrocarbon or functionalized hydrocarbon group having 1 to 30 carbon atoms, all of $R_2$ through $R_5$ are hydrogen, $X_1$ is nitrogen, m is 2, and n is 1; and N-hydrocarbyl carbazide derivatives (hydrocarbyl denotes hydrocarbon group) wherein $R_1$ is a hydrocarbon or functionalized hydrocarbon group having 1 to 30 carbon atoms, $R_2$, $R_4$ and $R_5$ are each hydrogen, $R_3$ is a hydrocarbon or functionalized hydrocarbon group having 1 to 10 carbon atoms, $X_1$ is nitrogen, m is 2, and n is 1.

The foregoing carbazinamide derivatives may be synthesized by any conventional method such as the following methods.

(1) Synthesis example of carbazinamide (semicarbazide) derivatives and carbazide derivatives by the reaction of an isocyanate and hydrazines:

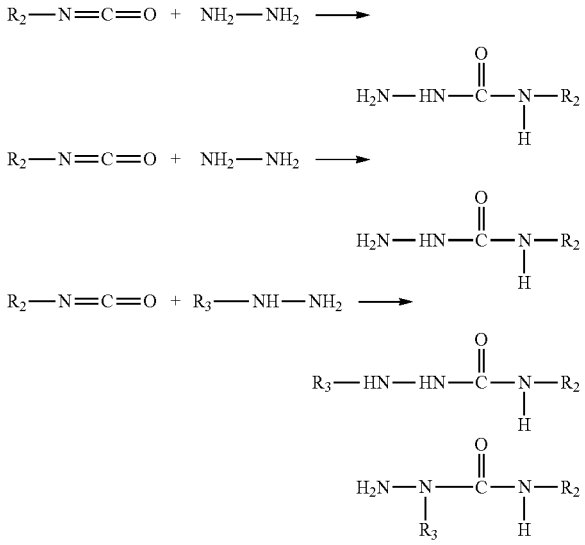

(2) Synthesis example of carbazinamide (semicarbazide) derivatives and carbazide derivatives by the reaction of carbonate, an aliphatic amine and hydrazines:

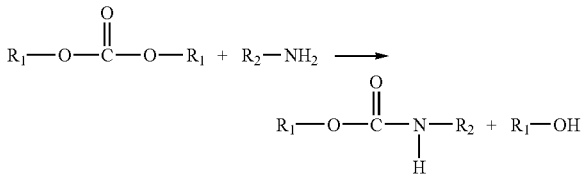

-continued

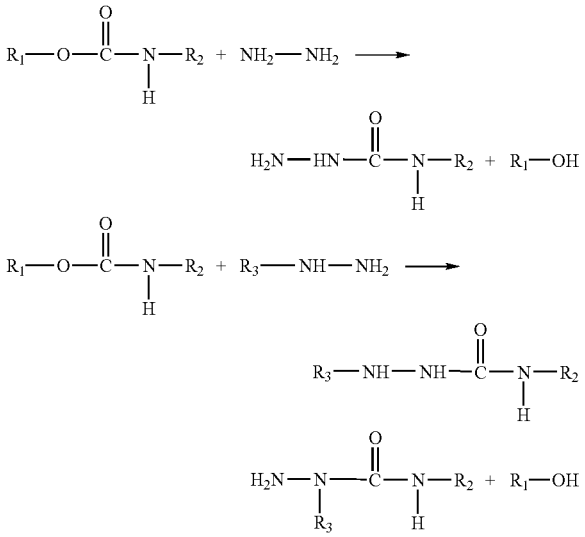

An isocyanate which may be used in the above synthesis may be any conventional isocyanate compound. Examples of an isocyanate include those having a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms.

A carbonate which may be used in the above synthesis may be any conventional carbonate compound. Examples of a carbonate include those having in their molecules at least one hydrocarbon group having one or more carbon atoms, preferably straight-chain or branched alkyl or alkenyl group, more preferably straight-chain alkyl or alkenyl group having 1 to 30 carbon atoms, and particularly preferably straight-chain alkyl or alkenyl group having 1 to 10 carbon atoms.

Hydrazines which may be used in the above synthesis may be any conventional hydrazine compound. Examples of hydrazines include hydrazine and those having in their molecules at least one hydrocarbon or functionalized hydrocarbon group having 1 to 10 carbon atoms, preferably a hydrocarbon group having 1 to 4 carbon atoms such as N-methylhydrazine, N-ethylhydrazine, N-tertbutylhydrazine, and N,N-dimethylhydrazine.

An aliphatic amines which may be used in the above synthesis may be any conventional aliphatic amine compound. Examples of an aliphatic amine include those having in their molecules at least one hydrocarbon or functionalized hydrocarbon group having 1 to 30 carbon atoms, preferably hydrocarbon or functionalized hydrocarbon group having 10 to 30 carbon atoms, more preferably an alkyl, alkenyl or functionalized hydrocarbon group having 12 to 20 carbon atoms, and particularly preferably alkenyl group having 12 to 20 carbon groups.

Examples of hydrocarbon groups having one or more carbon atoms include straight-chain or branched alkyl groups such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; and straight-chain or branched alkenyl group wherein the position of the double bond may vary, such as hexenyl, heptenyl, octenyl, noneyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, and triacontyl group.

Compounds represented by formula (3) correspond to compounds represented by formula (1) wherein a is 0, b is 0, c is 1, and d is 1. In formula (3), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, $R_2$ and $R_3$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen, and X is oxygen or sulfur, preferably oxygen.

Preferred examples of nitrogen-containing compounds represented by formula (3) for example wherein X is oxygen include urea compounds having a hydrocarbon or functionalized hydrocarbon group, each having 1 to 30 carbon atoms.

The urea compounds may be synthesized by any conventional method and for example may be synthesized by reacting an isocyanate with ammonia or an amine compound as represented below:

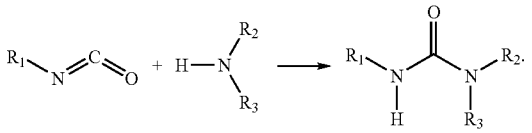

An isocyanate which may be used in the above synthesis may be any conventional isocyanate compound. Examples of an isocyanate include those having a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms.

Examples of an amine compound which may be used in the above synthesis include those having a hydrocarbon or functionalized hydrocarbon group having 1 to 30 carbon atoms, preferably a hydrocarbon group having 1 to 10 carbon atoms, and more preferably a hydrocarbon group having 1 to 4 carbon atoms.

Specific preferred examples of Component (A-2) include urea compounds having at least one alkyl or alkenyl group having 12 to 20 carbon atoms, such as dodecyl urea, tridecyl urea, tetradecyl urea, pentadecyl urea, hexadecyl urea, heptadecyl urea, octadecyl urea, oleyl urea, and stearyl urea.

Compounds represented by formula (4) corresponds to compounds represented by formula (1) wherein a is 1, b is 0, c is 1, d is 1, and e is 0. In formula (4), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, $R_2$ through $R_4$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen, and $X_1$ and $X_2$ are each oxygen or sulfur, preferably oxygen.

Preferred examples of nitrogen-containing compounds represented by formula (4) for example wherein $X_1$ and $X_2$ are each oxygen include ureid compounds having a hydrocarbon or functionalized hydrocarbon group having 1 to 30 carbon atoms.

The ureid compounds may be synthesized by any conventional method and for example may be synthesized by reacting urea or a urea compound with an acid chloride as represented below:

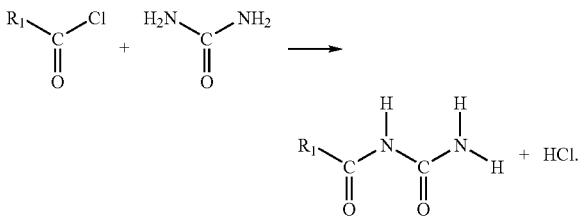

An acid chloride which may be used may be any conventional acid chloride compound. Examples of an acid chloride include chlorides of carboxylic acids having a hydrocarbon group having one or more carbon atoms or a functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms.

Examples of the urea compound include urea, N-methylurea, N-ethylurea, N-tert-butylurea, and N,N-dimethylurea which may be obtained by the reaction of an isocyanate with ammonia or an amine compound as represented below:

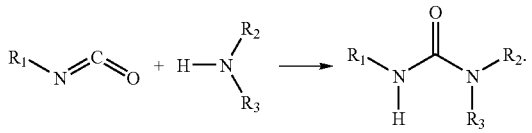

An isocyanate which may be used in the above synthesis may be any conventional isocyanate compound. Examples of an isocyanate include those having a hydrocarbon or functionalized hydrocarbon group having 1 to 30 carbon atoms.

An amine compound which may be used in the above synthesis may be any of those having a hydrocarbon or functionalized hydrocarbon group having 1 to 30 carbon atoms, preferably a hydrocarbon group having 1 to 10 carbon atoms, and more preferably a hydrocarbon group having 1 to 4 carbon atoms.

Specific preferred examples of Component (A-3) include ureid compounds having at least one alkyl or alkenyl group having 12 to 20 carbon atoms, such as dodecyl ureid, tridecyl ureid, tetradecyl ureid, pentadecyl ureid, hexadecyl ureid, heptadecyl ureid, octadecyl ureid, oleyl ureid, and stearyl ureid.

Compounds represented by formula (5) corresponds to compounds represented by formula (1) wherein a is 1, b is 0 or 1, c is an integer of 1 or greater, d is 1, e is 1, and f is 0 or 1. In formula (5), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, $R_2$ through $R_5$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen, and $X_1$ is oxygen or nitrogen, preferably nitrogen, $X_2$ and $X_3$ are each independently oxygen or sulfur, preferably oxygen, p is 0 or 1, preferably 1, m is 0 or 1, preferably 0, n is an integer of 1 or more, preferably 1 or 2, and more preferably 1.

Preferred examples of nitrogen-containing compounds represented by formula (5) for example wherein $X_1$, $X_2$ and $X_3$ are each oxygen include a group of compounds having a hydrocarbon or functionalized hydrocarbon group having 1 to 30 carbon atoms, such as allophanic esters and hydantoic esters.

Preferred examples of nitrogen-containing compounds represented by formula (5) for example wherein $X_1$ is nitrogen, and $X_2$ and $X_3$ are each oxygen include biurets (allophanamides) and hydantoinamides, each having a hydrocarbon or functionalized hydrocarbon group having 1 to 30 carbon atoms.

The allophanic esters may be synthesized by any conventional synthesis method such as the following methods:

(1) synthesis by the reaction of chlorocarbonic ester and urea;

(2) synthesis by the reaction of steam of cyanic acid and an anhydrous alcohol; and (3) synthesis by the reaction of urethane and carbamyl chloride, phosgene or thionyl chloride.

The allophanamides may be synthesized by any conventional synthesis method and for example may be synthesized by the reaction of the foregoing allophanic ester and an amine compound as represented below:

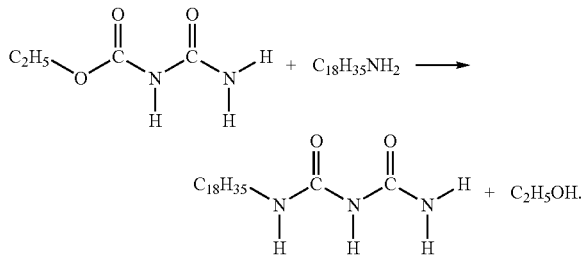

The hydantoinamides may be synthesized by the reaction of a hydatonic ester and an amine compound as represented below:

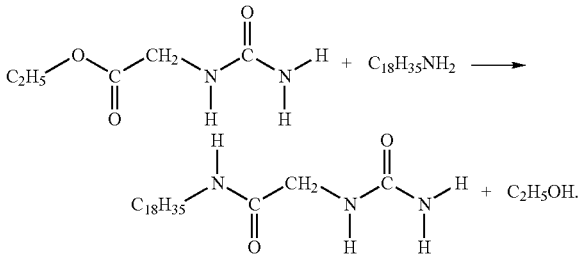

The allophanic esters may be those which have been conventionally used. Examples of allophanic esters include those having a hydrocarbon or functionalized hydrocarbon group having one or more carbon atoms, preferably a hydrocarbon or functionalized hydrocarbon group having 30 or fewer carbon atoms, more preferably a hydrocarbon or functionalized hydrocarbon group having 10 or fewer carbon atoms, even more preferably an alkyl, alkenyl or functionalized hydrocarbon group having 4 or fewer carbon atoms, and particularly preferably an alkyl group having 4 or fewer carbon atoms.

The hydatonic esters are those which have been conventionally used. Examples of hydatonic esters include those having a hydrocarbon or functionalized hydrocarbon group having one or more carbon atoms, preferably a hydrocarbon or functionalized hydrocarbon group having 30 or fewer carbon atoms, more preferably a hydrocarbon or functionalized hydrocarbon group having 10 or fewer carbon atoms, even more preferably an alkyl, alkenyl or functionalized hydrocarbon group having 4 or fewer carbon atoms, and particularly preferably an alkyl group having 4 or fewer carbon atoms.

Examples of amine compounds include those having a hydrocarbon or functionalized hydrocarbon group having 1 to 30 carbon atoms, preferably a hydrocarbon group having 10 to 20 carbon atoms, and particularly preferably a hydrocarbon group having 12 to 18 carbon atoms. These amine compounds are preferably primary and secondary amines.

Specific preferred examples of Component (A-4) include allophanic esters such as methyl allophanate, ethyl allophanate, propyl allophanate, isoamyl allophanate, octyl allophanate, cetyl allophanate, monoglycol allophanate, monoglyceryl allophanate, phenyl allophanate, benzyl allophanate, dodecyl allophanate, tridecyl allophanate, tetradecyl allophanate, pentadecyl allophanate, hexadecyl allophanate, heptadecyl allophanate, octadecyl allophanate, oleyl allophanate, and stearyl allophanate; allophanamide having at least one alkyl or alkenyl group having 12 to 20 carbon atoms, such as dodecyl allophanamide, tridecyl allophanamide, tetradecyl allophanamide, pentadecyl allophanamide, hexadecyl allophanamide, heptadecyl allophanamide, octadecyl allophanamide, oleyl allophanamide, and stearyl allophanamide; hydantoic esters such as methyl hydantoate, ethyl hydantoate, propyl hydantoate, isoamyl hydantoate, octyl hydantoate, cetyl hydantoate, monoglycol hydantoate, monoglyceryl hydantoate, phenyl hydantoate, benzyl hyndantoate, dodecyl hydantoate, tridecyl hyndantoate, tetradecyl hydantoate, pentadecyl hyndantoate, hexadecyl hyndantoate, heptadecyl hyndantoate, octadecyl hyndantoate, oleyl hyndantoate, and stearyl hyndantoate; and hydantoinamides having at least one alkyl or alkenyl group having 12 to 20 carbon atoms, such as dodecyl hydantoinamide, tridecyl hydantoinamide, tetradecyl hydantoinamide, pentadecyl hydantoinamide, hexadecyl hydantoinamide, heptadecyl hydantoinamide, octadecyl hydantoinamide, oleyl hydantoinamide, and stearyl hydantoinamide.

Compounds represented by formula (6) correspond to compounds represented by formula (1) wherein a is 1, b is 0, c is 0, d is 2, e is 0, X is oxygen. In formula (6), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, and $R_2$ through $R_4$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen.

Specific examples of nitrogen-containing compounds represented by formula (6) include hydrazides having a hydrocarbon or functionalized hydrocarbon group having 1 to 30 carbon atoms, and derivatives thereof. The nitrogen-containing compounds are hydrazides having a hydrocarbon or functionalized hydrocarbon group having 1 to 30 carbon atoms when $R_1$ is a hydrocarbon or functionalized hydrocarbon group having 1 to 30 carbon atoms, and $R_2$ through $R_4$ are each hydrogen. The nitrogen-containing compounds are N-hydrocarbyl hydrazides (hydrocarbyl denotes hydrocarbon group) having a hydrocarbon or functionalized hydrocarbon group having 1 to 30 carbon atoms when $R_1$ and either one of $R_2$ through $R_4$ are each a hydrocarbon or functionalized hydrocarbon group having 1 to 30 carbon atoms and the rest of $R_2$ through $R_4$ are each hydrogen.

The nitrogen-containing compounds represented by formula (6) may be synthesized by any conventional synthesis method, for examples a method disclosed in U.S. Patent Application Publication No. 2003/0008785. The following methods may also be employed:

(1) synthesis by the reaction of an ester of an organic acid and hydrazines as represented below:

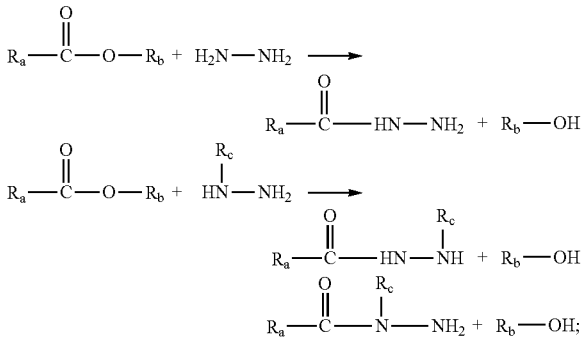

(2) synthesis by the reaction of an organic acid chloride or an organic acid anhydrate and hydrazines; and (3) synthesis by the reaction of an organic acid amide and hydrazine or hydrazines.

The foregoing organic acid ester, organic acid chloride, organic acid anhydrate, and organic acid amide may be those which have been conventionally used. Examples of organic acid esters include esters of organic acids having a hydrocarbon or functionalized hydrocarbon group having 1 to 30 carbon atoms, preferably a hydrocarbon group having 10 to 30 carbon atoms or a functionalized hydrocarbon group having 9 to 30 carbon atoms, more preferably an alkyl, alkenyl or functionalized hydrocarbon group having 11 to 20 carbon atoms, and particularly preferably an alkenyl group having 11 to 20 carbon atoms, i.e., aliphatic carboxylic acids, aromatic carboxylic acids, or alicyclic carboxylic acids which may be mono-, di-, or tricarboxylic acids or oxycarboxylic acids, and alcohols having 1 to 30 carbon atoms. Examples of organic acid chlorides, organic acid anhydrates, and organic acid amides include chlorides and anhydrates of the above-described organic acids, and amides thereof with ammonia or organic amines which may be monoamines, diamines, polyamines, or alkanolamines.

The hydrazines may be those which have been conventionally used. Examples of hdyrazines include hydrazine, hydrazines having in their molecules at least one hydrocarbon or functionalized hydrocarbon group having 1 to 10 carbon atoms, preferably at least one hydrocarbon group having 1 to 4 carbon atoms, such as N-methylhydrazine, N-ethylhydrazine, N-tert-butylhydrazine, and N,N-dimethylhydrazine.

Component (A-5), i.e., hydrazine derivative in the present invention may be obtained by modifying a nitrogen-containing compound represented by formula (6) with acid or a salt thereof.

Examples of acid which may be used include boric acid, phosphoric acid, and carboxylic acids. Examples of salts which may be used include boric acid salts, phosphoric acid salts, and carboxylic acid salts. Any mixture of these compounds may be used. Among these, particularly preferred are boric acid and boric acid salts.

Component (A-5) may be synthesized by any suitable method. For example, a nitrogen-containing compound represented by formula (6) and boric acid, phosphoric acid or a carboxylic acid are taken into an organic solvent such as hexane, toluene, or xylene, to which water is added if necessary, are reacted at a temperature of 50 to 99° C. for 0.5 to 5 hours. After the water is distilled out at a temperature of 100° C. or higher, the organic solvent layer is cooled so as to allow white crystal to precipitate, followed by vacuum-filtration, thereby obtaining Component (A-5). If necessary, the white crystal thus obtained is preferably washed with an organic solvent such as toluene or methanol at a temperature at which the white crystal is hard to dissolve, for example at room temperature so as to remove the organic solvent adhered to the white crystal thereby obtaining Component (A-5) with a high purity.

There is no particular restriction on the reaction rate between a nitrogen-containing compound represented by formula (6) and acid or a salt thereof. However, 0.05 to 1 mole, preferably 0.2 to 1 mole, and particularly preferably 0.5 to 1 mole of acid or a salt thereof is reacted with 1 mole of a nitrogen-containing compound represented by formula (6).

The lubricating oil additive comprising the hydrazide derivative of the present invention may be blended with at least one kind selected from lubricating base oils, anti-wear agents, ashless dispersants, antioxidants, metallic detergents, friction modifiers, viscosity index improvers, corrosion inhibitors, rust inhibitors, demulsifiers, metal deactivators, anti-foaming agents, seal swelling agents, and dyes, so as to be used as a lubricating oil additive composition.

Compounds represented by formula (7) correspond to compounds represented by formula (1) wherein a is 1, b is 0, c is 0, d is 2, e is from 0 to 2, and f is 0 or 1. In formula (7), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, and $R_2$ through $R_5$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen, $X_1$ is oxygen, nitrogen, or sulfur, preferably oxygen or nitrogen, and more preferably nitrogen, $X_2$ is oxygen or sulfur, preferably oxygen, m is from 0 to 2, preferably 0 or 1, and particularly preferably 1, and n is 0 or 1, preferably 1.

Specifically, nitrogen-containing compounds represented by formula (7) are hydrazide derivatives having a hydrocarbon or functionalized hydrocarbon group having 1 to 30 carbon atoms when m is 0, and $X_2$ is oxygen, more specifically hydrazides having a hydrocarbon or functionalized hydrocarbon group having 1 to 30 carbon atoms when m is 0, $X_2$ is oxygen, $R_1$ is a hydrocarbon or functionalized hydrocarbon group having 1 to 30 carbon atoms, and $R_2$ through $R_5$ are each hydrogen; and N-hydrocarbyl hydrazide (hydrocarbyl denotes hydrocarbon) having a hydrocarbon or functionalized hydrocarbon group having 1 to 30 carbon atoms when m is 0, $X_2$ is oxygen, $R_1$ and either one of $R_2$ through $R_5$ are each a hydrocarbon or functionalized hydrocarbon group having 1 to 30 carbon atoms, and the remainders thereof are each hydrogen. The hydrazine derivatives may be synthesized by any of the above-described synthesis methods.

Preferred examples of nitrogen-containing compounds represented by formula (7) wherein $X_1$ is nitrogen and $X_2$ is oxygen include carbazinamide (semicarbazide) derivatives and carbazide derivatives each having a hydrocarbon or functionalized hydrocarbon group having 1 to 30 carbon atoms.

Specific examples of the foregoing carbazinamide derivatives include carbazinamide derivatives wherein $R_1$ is a hydrocarbon or functionalized hydrocarbon group having 1 to 30, all of $R_2$ through $R_5$ are hydrogen, $X_1$ is nitrogen, m is 1, and n is 1; N-hydrocarbyl carbazinamide derivatives (hydrocarbyl denotes hydrocarbon group) wherein $R_1$ is a hydrocarbon or functionalized hydrocarbon group having 1 to 30, $R_2$, $R_4$, and $R_5$ are each hydrogen, $R_3$ is a hydrocarbon or functionalized hydrocarbon group having 1 to 10, $X_1$ is nitrogen, m is 1, and n is 1; carbazide derivatives wherein $R_1$ is a hydrocarbon or functionalized hydrocarbon group having 1 to 30, all of $R_2$ through $R_5$ are hydrogen, $X_1$ is nitrogen, m is 2, and n is 1; and N-hydrocarbyl carbazide derivatives (hydrocarbyl denotes hydrocarbon group) wherein $R_1$ is a hydrocarbon or functionalized hydrocarbon group having 1 to 30, $R_2$, $R_4$, and $R_5$ are each hydrogen, $R_3$ is a hydrocarbon or functionalized hydrocarbon group having 1 to 10, $X_1$ is nitrogen, m is 2, and n is 1.

The foregoing carbazinamide derivatives and carbazide derivative may be synthesized by any conventional method such as those described above.

Boric acid salts, phosphoric acid salts, and carboxylic acid salts of nitrogen-containing compounds represented by formula (7) obtained by reacting thereto boric acid, phosphoric acid, a carboxylic acid or a salt thereof, and mixtures of these salts may be used as a component of Component (A-6) of the present invention.

Organic metal salts and organic metal complexes used for preparation of Component (A-6) are those formed from metal, a metal oxide, a metal hydroxide, a metal chloride and a salt and an organic substance capable of forming a salt or a complex. Examples of such an organic substance include organic acids having at least one hydrocarbon or functionalized hydrocarbon group having one or more carbon atoms and organic compounds having a hydroxyl group. Specific examples include those having at least one hydrocarbon or functionalized hydrocarbon group having one or more carbon atoms, such as carboxylic acids, naphthenic acid, phosphoric acid, thiophosphoric acid, dithiophosphoric acid, phosphonic acid, thiophosphonic acid, dithiophosphonic acid, sulfonic acid, salicylic acid, carbamic acid, thiocarbamic acid, dithiocarbamic acid, alcohols, phenols, partial esters, partial ethers, carbonates, and derivatives thereof.

Examples of hydrocarbon groups having one or more carbon atoms include those having 1 to 30 carbon atoms described above as well as those having 31 or more, for example 31 to 60 carbon atoms.

Preferred examples of organic metal salts include metal salts of phosphates, thiophosphates, dithiophosphates, phosphonates, thiophosphonates, dithiophosphonates, carbamic acid, thiocarbamic acid, dithiocarbamic acid, and naphthenic acid, each having at least one hydrocarbon group having 3 to 20, preferably 4 to 18 carbon atoms.

There is no particular restriction on metals used herein. Examples of such metals include alkali metals such as lithium, sodium, potassium, and cesium, alkaline earth metals such as calcium, magnesium, and barium, and heavy metals such as zinc, copper, iron, lead, nickel, silver, manganese, and molybdenum. Preferred metals are at least one kind of metal selected from magnesium, calcium, zinc, copper, and molybdenum. Particularly preferred is zinc.

Component (A-6), i.e., oil soluble metal complex may be obtained by mixing (a) at least one kind of compound selected from Components (A-1), (A-2), (A-3), (A-4), and (A-5) and nitrogen-containing compounds represented by formula (7) with (b) an organic metal salt and/or an organic metal complex. However, Component (A-6) may be an oil soluble metal complex obtained by mixing the mixture of (a) and (b) with (c) an amine compound.

Component (a) is preferably a nitrogen-containing compound represented by formula (7) sparingly soluble at a relatively low temperature (for example 60° C. or lower) or a acid-modified derivative thereof.

It is assumed that Component (c), i.e., amine compound forms a complex with Component (b) and forms a composite oil soluble metal complex formed from Components (a), (b), and (c). Component (c) is useful when used in combination with Components (b), particularly an organic metal salt or an organic metal complex which is sparingly soluble in oil, such as a metal salt of a phosphate or phosphonate is used, and may be mixed with such a metal salt in advance so that the metal salt is dissolved or allowed to form a complex so as to be rendered oil soluble.

Preferred examples of amine compounds include amine-based antioxidants, ashless dispersants and/or derivatives thereof, and aliphatic amines represented by R—$NH_2$, R—NHR, and $NR_3$.

Examples of amine-based antioxidants include those which are generally known in the field of lubricating oils, such as aromatic amine compounds, alkyldiphenylamines, alkylnaphtylamines, phenyl-α-naphtylamines, and alkylphenyl-α-naphtylamines. These antioxidants are preferably in a liquid state at ordinary temperature. The term "alkyl" used herein denotes an alkyl group having 1 to 30, preferably 3 to 20, and particularly preferably 4 to 10 carbon atoms, whose substitution number is from 1 to 4, preferably 1 or 2.

The ashless dispersant used herein is preferably at least one compound selected from (D-1) succinimides; (D-2) benzylamines; (D-3) polyamines each described below; Mannich reaction products of an alkyl- or alkenylphenol, formaldehyde, and a polyamine, and derivatives thereof.

Examples of (D-1) succunimides include compounds represented by formulas (17) and (18) described later. Examples of (D-2) benzylamines include compounds represented by formula (19) described later. Examples of (D-3) polyamines include compounds represented by formula (20) described later.

The foregoing ashless dispersant and/or derivative thereof has a base number determined by hydrochloric acid method of preferably 5 mgKOH/g or greater, more preferably 10 mgKOH/g or greater, and particularly preferably 20 mgKOH/g or greater. The term "base number" used herein denotes a base number measured by the hydrochloric acid potentiometric titration method in accordance with section 6 of JIS K2501 "Petroleum products and lubricants-Determination of neutralization number".

Examples of derivatives of ashless dispersants include various modified compounds obtained by allowing any of (D-1) to (D-3) nitrogen-containing compounds to react with a boric compound, an oxygen-containing organic compound, a sulfuric compound, or a combination of two or more of these compounds to neutralize or amidize the whole or part of the remaining amino and/or imino groups.

Examples of boric compounds include boric acid, salts thereof, and boric acid esters. Specific examples of boric acid include orthoboric acid, metaboric acid, and tetraboric acid. Examples of boric acid salts include alkali metal salts, alkaline earth metal salts, and ammonium salts of boric acid, more specifically lithium borates such as lithium metaborate, lithium tetraborate, lithium pentaborate, and lithium perborate; sodium borates such as sodium metaborate, sodium diborate, sodium tetraborate, sodium pentaborate, sodium hexaborate, and sodium octaborate; potassium borates such as potassium metaborate, potassium tetraborate, potassium pentaborate, potassium hexaborate, and potassium octaborate; calcium borates such as calcium metaborate, calcium diborate, tricalcium tetraborate, pentacalcium tetraborate, and calcium hexaborate; and magnesium borates such as magnesium metaborate, magnesium diborate, trimagnesium tetraborate, pentamagnesium tetraborate, and magnesium hexaborate; and ammonium borates such as ammonium metaborate, ammonium tetraborate, ammonium pentaborate, and ammonium octaborate.

Examples of boric acid esters include esters of boric acid and an aliphatic alcohols preferably having 1 to 6 carbon atoms, more specifically monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

Succinimide derivatives obtained by allowing (D-1) succinimides to react with the above-described boric compound are preferably used because they can impart heat resistance and oxidation stability to a lubricating oil composition. There is no particular restriction on the equivalent weight ratio of boron to nitrogen (B/N equivalent weight ratio). However, the equivalent weight ratio is preferably 1 or less, more preferably 0.7 or less, and particularly preferably 0.5 or less because Components (a) and (b) can easily form a complex.

Specific examples of oxygen-containing organic compounds include monocarboxylic acids having 1 to 30 carbon atoms, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid, and eicosanoic acid; polycarboxylic acids having 2 to 30 carbon atoms, such as oxalic acid, phthalic acid, trimellitic acid and pyromellitic acid, and anhydrate and esterified compounds thereof; alkylene oxides having 2 to 6 carbon atoms; and hydroxy(poly)oxyalkylenecarbonate. It is assumed that the whole or part of the amino and/or imino groups of compounds represented by formulas (17) to (20) take a structure represented by formula (12) below by reacting with any of these oxygen-containing organic compounds:

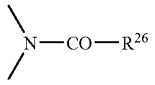

(12)

wherein $R^{26}$ is selected from hydrogen, alkyl, alkenyl, and alkoxy groups having 1 to 24 carbon atoms, and hydroxy (poly)oxyalkylene groups represented by —O—$(R^{27}O)_mH$ wherein $R^{27}$ is an alkylene group having 1 to 4 carbon atoms, and m is an integer of 1 to 5.

Components (D-1) through (D-3) and derivatives thereof are particularly preferably used because it is assumed that they form a complex by reacting with Components (a) and (b) and enable these components to be present stably in a lubricating oil additive or a lubricating oil composition and thus the manufacturing time thereof to be shortened. Among these ashless dispersants, preferred are (D-1) succinimides and/or derivatives thereof and boric compound derivatives of (D-1) to (D-3), and particularly preferred are boric compound derivatives of (D-1) succinimides because they can enhance the heat resistance and oxidation stability of the lubricating oil additive or lubricating oil composition of the present invention.

Examples of other amine compounds for Component (c) include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, propylbutylamine, pentylmethylamine, hexylmethylamine, heptylmethylamine, octylmethylamine, nonylmethylamine, decylmethylamine, undecylmethylamine, dodecylmethylamine, tridecylmethylamine, tetradecylmethylamine, pentadecylmethylamine, hexadecylmethylamine, heptadecylmethylamine, octadecylmethylamine, trimethylamine, ethyldimethylamine, propyldimethylamine, butyldimethylamine, hexyldimethylamine, octyldimethylamine, decyldimethylamine, dodecyldimethylamine, and octadecyldimethylamine; alkenylamines having a straight-chain or branched alkenyl group having 2 to 30 carbon atoms, such as ethenylamine, propenylamine, butenylamine, octenylamine, oleylamine, octenylmethylamine, decenylmethylamine, dodecenylmethylamine, octadecenylmethylamine, octenyldimethylamine, decenyldimethylamine, dodecenyldimethylamine, and octadecenyldimethylamine; alicyclic amines having a cycloalkyl, alkyl- or alkenylcycloalkyl group having 3 to 30 carbon atoms (these alkyl and alkenyl groups may be straight-chain or branched and bonded to anywhere) such as cyclohexylamine, methylcyclohexylamine, and ethylcyclohexylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, decanolamine, dodecanolamine, octadecanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these amine compounds, preferred examples include aliphatic amines having an straight-chain or branched alkyl or alkenyl group having 8 to 20, preferably 12 to 18 carbon atoms, such as decylamine, dodecylamine, tridecylamine, heptadecylamine, octadecylamine, oleylamine, stearylamine, decyldimethylamine, undecyldiethylamine, undecyldiethanolamine, dodecyldimethylamine, tridecyldimethylamine, heptadecyldimetylamine, octadecyldimethylamine, oleydimethylamine, and stearyldimethylamine.

Among these Components (c), the use of aliphatic amines, preferably aliphatic monoamines can render the resulting lubricating oil additive to be improved in the friction reducing effect between metals in an engine. Particularly, when an aliphatic tertiary amine is used, the resulting lubricating oil additive can be further improved in extreme pressure properties.

Any one or a mixture of two or more of the above-exemplified amine compounds may be used as Component (c).

There is no particular restriction on the method of producing Component (A-6), i.e., oil soluble metal complex. For example, Component (A-6) may be obtained by mixing Components (a) and (b); Components (a), (b), and (c); Component (a) and an oil soluble mixture obtained in advance by mixing Components (b) and (c); or a mixture of Components (a) and (c) and Component (b). There is no particular restriction on the mixing temperature. Since at 60° C. or lower it is very time-consuming to form a complex, the mixing temperature is preferably 70° C. or higher, more preferably 80° C. or higher, even more preferably 90° C. or higher, and particularly preferably the melting point of Component (A) or higher, and preferably 200° C. or lower, more preferably 150° C. or lower, and particularly preferably 120° C. or lower. Any of the above-described combination of materials is mixed directly or in an organic solvent until forming a complex thereby obtaining Component (A-6). The mixing time is from 5 minutes to 5 hours, preferably 20 minutes or longer, and particularly preferably 30 minutes or longer. When the organic solvent is a lubricating base oil, the mixture as it is may be provided as the lubricating oil additive containing the oil soluble metal complex of the present invention. When the organic solvent is an organic solvent with no lubricative viscosity such as hexane, benzene, toluene, xylene or decaline, Component (A-6) may be obtained by distilling the organic solvent by vacuum-distillation.

There is no particular restriction on the mix ratio of Components (a) and (b) or Components (a) (b), or (c) when Component (A-6) is prepared. However, one part by mass of Component (b) is mixed with 0.01 to 30 part by mass, preferably 0.15 part by mass or more, more preferably 0.2 part by mass or more, even more preferably 0.3 part by mass or more, still even more preferably 0.5 part by mass or more, and particularly preferably 0.8 part by mass or more and 10 parts by mass or less, preferably 5 parts by mass or less of Component (a) or Components (a) and (c).

The kind and amount of each of Components (a) (b) and (c) are preferably so selected that the oil soluble metal complex obtained as described above becomes an oil soluble metal complex represented by formula (13) below for example when Component (a) is a nitrogen-containing compound represented by formula (7):

(13)

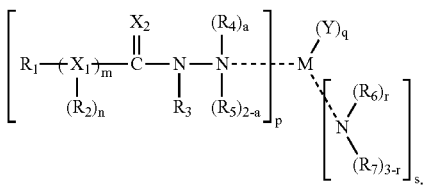

In formula (13), $R_1$ is a hydrocarbon or functionalized hydrocarbon group having 1 to 30, $R_2$ through $R_7$ are each independently a hydrocarbon or functionalized hydrocarbon group having 1 to 30 or hydrogen, $X_1$ is oxygen, nitrogen, or sulfur, $X_2$ is oxygen or sulfur, m is an integer of 0 to 2, a and p are each independently an integer of 1 or 2, n is an integer of 0 or 1, r is an integer of 1 to 3, s is an integer of 0 to 2, M is metal, and Y is a group selected from those represented by the following formulas:

(14)

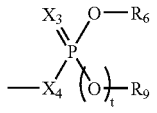

(15)

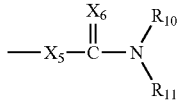

(16)

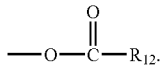

In formulas (14) to (16), $R_8$ through $R_{11}$ are each independently a hydrocarbon group having 3 to 20 carbon atoms, $R_{12}$ is a hydrocarbon or functionalized hydrocarbon group having 1 to 30 carbon atoms, $X_3$ through $X_6$ are each independently oxygen or sulfur, and t is an integer of 0 or 1.

Metal for M above is at least one kind of metal selected from magnesium, calcium, zinc, copper, and molybdenum, preferably zinc.

Component (A-6), i.e., oil soluble metal complex as obtained above can render Component (a) which is relatively low in solubility in oil to be easily dissolved a lubricating base oil at a relatively low temperature (for example 60° C. or lower) and can retain Component (a) in a dissolved state stably at a low temperature to high temperature. Therefore, Component (A-6) is easily applicable to a lubricating oil additive or lubricating oil composition.

A lubricating oil additive comprising Component (A-6) is that containing the above-described oil soluble metal complex and may be provided in the form of an additive package wherein Component (A6) is mixed with one or more components selected from ashless dispersants, antioxidants, friction modifier, anti-wear agents, metallic detergents, viscosity index improvers, corrosion inhibitors, rust inhibitors, demulsifiers, metal deactivators, seal swelling agents, anti-foaming agents, dyes, and lubricating base oils for adjusting lubricity, depending on the required performances of a lubricating oil composition. In this case, in addition to Components (a) and (b) or Components (a), (b), and (c), these various additives and if necessary the lubricating base oil may be mixed under the above-described conditions, or alternatively, the oil soluble metal complex may be mixed with these various additives and if necessary the lubricating base oil at from room temperature to 200° C., preferably 30° C. or higher, more preferably 40° C. or higher and preferably 150° C. or lower, more preferably 120° C. or lower, even more preferably 90° C. or lower, and 60° C. or lower.

Specific examples of hydrocarbon groups having 1 to 30 carbon atoms in formulas (1) through (7) and (12) through (16) include alkyl, cycloalkyl, alkenyl, alkyl-substituted cycloalkyl, aryl, alkyl-substituted aryl, and arylalkyl groups.

Examples of alkyl groups include straight-chain or branched alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of cycloalkyl groups include those having 5 to 7 carbon atoms, such as cyclopentyl, cyclohexyl, and cycloheptyl groups. Examples of alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups, of which the alkyl groups may bond to any position of the cycloalkyl groups.

Examples of alkenyl groups include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl and octadecenyl groups, all of which may be straight-chain or branched and the position of which the double bonds may vary.

Examples of aryl groups include phenyl and naphtyl groups. Examples of alkylaryl groups include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Examples of functionalized hydrocarbon groups having 1 to 30 carbon atoms include those containing the above described hydrocarbon groups and oxygen, nitrogen, sulfur, or phosphorus such as those derived from esters, carboxylic acids, ethers, amides, and amines.

Component (A) may be acid-modified derivatives of nitrogen-containing compounds represented by formulas (2) to (6), such as boric acid salts, phosphoric acid salts, or carboxylic acid salts thereof obtained by allowing the nitrogen-containing compounds to react with boric acid, phosphoric acid, or carboxylic acid, or a salt thereof. These acid-modified derivatives may be synthesized by the methods described with respect to Component (A5), i.e., hydrazide derivatives.

In the present invention, the above-described Component (A), i.e., lubricating oil additive may be mixed with at least one kind of additive selected from lubricating base oils, ashless dispersants, antioxidant, friction modifiers, anti-wear agents, metallic detergents, viscosity index improvers, corrosion inhibitors, rust inhibitors, demulsifiers, metal deactivators, anti-foaming agents, seal swelling agents, and dyes so as to be provided in the form of a lubricating oil additive composition, i.e., an additive package.

The lubricating oil composition of the present invention is a composition obtained by mixing a major amount of a base oil with Component (A) or the lubricating oil additive composition and alternatively an additive package or one or more kinds of additives selected from the above-exemplified additives in accordance with the requisite performance of the lubricating oil composition. The mixing temperature is from room temperature to 200° C., preferably 30° C. or higher, more preferably 40° C. or higher and preferably 150° C. or lower, more preferably 120° C. or lower, even more preferably 90° C. or lower, and particularly preferably 60° C. or lower.

There is no particular restriction on the contents of Component (A) and/or the lubricating oil additive composition. Component (A) is contained in an amount of 0.001 to 5% by mass, preferably 0.01 to 3% by mass, and particularly preferably 0.1 to 1.5% by mass, based on the total mass of the lubricating oil composition.

There is no particular restriction on the lubricating base oil of the lubricating oil composition of the present invention. Therefore, the base oil may be any conventional mineral and/or synthetic base oils.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax) produced through a Fischer-Tropsch process.

There is no particular restriction on the total aromatic content of mineral base oils. However, the total aromatic content is preferably 15% by mass or less, more preferably 10% by mass or less, even more preferably 6% by mass or less, still even more preferably 3% by mass or less and particularly preferably 2% by mass or less. Although the total aromatic content may be 0% by mass, it is preferably 1% by mass or more with the objective of solubility of additives. A base oil with a total aromatic content of 15% by mass or more is not preferably because the resulting composition would be poor in oxidation stability.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics, such as pyridines, quinolines, phenols, and naphthols.

There is no particular restriction on the sulfur content of mineral base oils. However, the sulfur content is preferably 0.05% by mass or less, more preferably 0.01% by mass or less, and particularly preferably 0.001% by mass or less. A low sulfur lubricating oil composition with more excellent long-drain properties can be obtained by decreasing the sulfur content of a mineral base oil.

Specific examples of synthetic base oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyolesters such as trimethylolpropane caprylate, trimethylolpropane pelargonate, pentaerythritol-2-ethyl hexanoate, and pentaerythritol pelargonate; copolymers of dicarboxylic acids such as dibutyl maleate and α-olefins having 2 to 30 carbon atoms; aromatic synthetic oils such as alkylnaphthalenes, alkylbenzenes, and aromatic esters; and mixtures thereof.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular restriction is imposed on the kinematic viscosity at 100° C. of the lubricating base oil used in the present invention, it is preferably 20 $mm^2/s$ or lower, more preferably 10 $mm^2/s$ or lower, and preferably 1 $mm^2/s$ or higher, more preferably 2 $mm^2/s$ or higher. A lubricating base oil with a kinematic viscosity at 100° C. exceeding 20 $mm^2/s$ is not preferable because the low temperature viscosity characteristics of the resulting lubricating oil composition would be deteriorated, while that with a kinematic viscosity at 100° C. of lower than 1 $mm^2/s$ is not also preferable because the resulting lubricating oil composition would be poor in lubricity due to its insufficient oil film formation capability at lubricated sites and large in evaporation loss of the base oil.

The evaporation loss of the base oil used in the present invention is preferably 20% by mass or less, more preferably 16% by mass or less, and particularly preferably 10% by mass or less, as measured by NOACK evaporation analysis. A lubricating base oil with a NOACK evaporation loss exceeding 20% by mass is not preferable because the resulting lubricating oil composition would be large in evaporation loss of the base oil and the sulfur and phosphorus compounds or metals in the composition would accumulate on an exhaust gas purifying device together with the base oil, resulting not only in the increase of oil consumption but also in adverse affect on the exhaust gas purifying performance. The term "NOACK evaporation" used herein is defined as the amount of a sample lubricating oil of 60 g, which is lost when the oil is retained at a temperature of 250° C. and a pressure of 20 $mmH_2O$ (196 Pa) for one hour in accordance with ASTM D 5800.

Although no particular restriction is imposed on the viscosity index of the lubricating base oil used, it is preferably 80 or higher, more preferably 100 or higher, and most preferably 120 or higher so as to be able to obtain excellent viscosity characteristics ranging from low temperatures to high temperatures. No particular limitation is imposed on the upper limit of the viscosity index. Therefore, the lubricating base oil may be those with a viscosity index of on the order of 135 to 180, such as n-paraffins, slack waxes and GTL waxes or isoparaffin-based mineral oils obtained by isomerization thereof and those with a viscosity index of on order of 150 to 250, such as complex ester-based or HVI-PAO-based base oils. A lubricating base oil with a viscosity index of less than 80 is not preferable because the low-temperature viscosity characteristics would be deteriorated.

The lubricating oil composition of the present invention preferably contains (B) a metal-containing phosphorus compound.

Examples of metal-containing phosphorus compounds include metal salts of phosphorus compounds having a hydrocarbon group having 1 to 30 carbon atoms. Examples of phosphorus compounds include phosphorus monoester, monothiophosphorus monoester, dithiophoshorus monoester, trithiophosphorus monoester, phosphorus diester, monothiophosphorus diester, dithiophosphorus diester, trithiophosphorus diester, phosphoric monoester, monothiophosphoric monoester, dithiophosphoric monoester, trithiophosphoric monoester, phosphoric diester, monothiophosphoric diester, dithiophosphoric diester, trithiophosphoric diester, phosphonic monoester, monothiophosphonic monoester, and dithiophosphonic monoester. Component (B) may be obtained by reacting these phosphorus compounds with a metal base such as a metal chloride, a metal hydroxide, or a metal oxide.

Examples of hydrocarbon groups having 1 to 30 carbon atoms include alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl groups; alkenyl groups such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, oleyl, octadecenyl, nonadecenyl, eicosenyl, heneicosenyl, docesenyl, tricosenyl, and tetracosenyl groups; cycloalkyl groups such as cyclopentyl, cyclohexyl and cycloheptyl groups; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, dipropylcyclopentyl, propylethylmethylcyclopentyl, methylcylohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, dipropylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, dipropylcycloheptyl, and propylethylmethylcycloheptyl groups; aryl groups such as phenyl and naphtyl groups; alkylaryl groups such as tolyl, xylyl, ethylphenyl, propylphenyl, ethylmethylphenyl, trimethylphenyl, butylphenyl, propylmetylphenyl, diethylphenyl, ethyldimethylphenyl, tetramethylphenyl, pentylphenyl, hexylphenyl, heptylphenyl, octylphenyl, nonylphenyl, decylphenyl, undecylphenyl, and dodecylphneyl groups; and arylalkyl groups such as benzyl, methylbenzyl, dimethylbenzyl, phenetyl, methylphenetyl, and dimethylphenetyl groups.

The above hydrocarbon group include those of all possible straight-chain or branched structure. The alkenyl groups may have the double bond at any position. The alkyl groups may bond to any position of the cycloalkyl group. The alkyl groups may bond to any position of the aryl groups. The aryl groups may bond to any position of the alkyl groups. These hydrocarbon groups may have a (poly)alkylene oxide such as (poly) ethylene oxide and (poly)propylene oxide.

Preferred examples of Component (B) include metal salts of phosphorus compounds having a primary, secondary or tertiary alkyl group having 3 to 24, preferably 4 to 18, and particularly preferably 4 to 12 carbon atoms, more specifically metal salts of phosphoric monoester, phosphoric diester, phosphonic monoester, monothiophosphoric monoester, monothiophosphoric diester, monothiophosphonic monoester, dithiophosphoric monoester, dithiophosphoric dithioester, and dithiophosphonic monoester, more preferably metal salts of dithiophosphoric mono- or diester, phosphoric mono- or diester, and phosphonic monoester, and particularly preferably metal salts of phosphoric mono- or diester and phosphonic monoester with the objective of further improving the oxidation stability, base number retention properties and high-temperature detergency of the composition.

There is no particular restriction on metals of these metal salts. Examples of metals include alkali metals such as lithium, sodium, potassium, and cesium, alkaline earth metals such as calcium, magnesium, and barium; and heavy metals such as zinc, copper, iron, lead, nickel, silver, manganese, and molybdenum. Among these, preferred are alkaline earth metals such as calcium and magnesium and zinc, and most preferred is zinc.

There is no particular restriction on the content of Component (B) in the lubricating oil composition of the present invention. However, the content is from 0.1 to 5% by mass, based on the total mass of the composition. When the lubricating oil composition of the present invention is used for an internal combustion engine, Component (B) is contained in an amount of preferably 0.1% by mass or less, more preferably 0.08% by mass or less in terms of phosphorus, based on the total mass of the composition considering of adverse affect on the exhaust-gas purifying device.

The lubricating oil composition of the present invention preferably contains (C) a phosphorus compound other than zinc dithiophosphate for enhancing the long-drain capability or the durability of friction reducing effect.

There is no particular restriction on Component (C). Therefore, Component (C) may be any conventional phosphorus compound other than zinc dithiophosphate, such as phosphoric ester-based compounds and phosphorus ester-based compounds. Among these compounds, preferred is (C-1) at least one kind of compound selected from phosphorus compounds represented by formula (8) and metal salts and amine salts thereof:

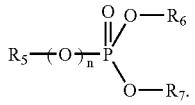

(8)

In formula (8), $R_5$ is a hydrocarbon group which may contain oxygen and/or nitrogen, having 1 to 30, preferably 3 to 24, and more preferably 4 to 18 carbon atoms, $R_6$ and $R_7$ are each independently a hydrocarbon group which may contain oxygen and/or nitrogen, having 1 to 30, preferably 1 to 24, and more preferably 1 to 18 carbon atoms or hydrogen, and n is an integer of 0 or 1. The hydrocarbon groups are preferably primary, secondary or tertiary alkyl groups.

More specific preferred examples of Component (C-1) include phosphoric monoester, phosphoric diester, phosphonic monoester, metal salt and amine salts thereof, phosphoric triester, and phosphonic diester. More preferred examples include metal salts of phosphoric mono- or diester, phosphoric triester, and metal salts of phosphonic monoester, and phosphonic diester with the objective of enhancing the oxidation stability, base number retention properties and high-temperature detergency of the composition. Particularly preferred are metal salts of phosphoric mono- or diester and phosphonic monoester with the objective of enhancing the solubility of Component (A) These metal salts of phosphorus compounds are preferably dissolved in or reacted with an amine compound in advance so as to be rendered oil soluble.

There is no particular restriction on metals of these metal salts. Examples of metals include alkali metals such as lithium, sodium, potassium, and cesium, alkaline earth metals such as calcium, magnesium, and barium; and heavy metals such as zinc, copper, iron, lead, nickel, silver, manganese, and molybdenum. Among these, preferred are alkaline earth metals such as calcium and magnesium and zinc, and most preferred is zinc.

Examples of amine compounds forming an amine salt include ashless dispersants such as aliphatic amines, aromatic amines, diamines, polyamines, alkanolamines, succinimides and derivatives thereof.

There is no particular restriction on the content of Component (C-1) in the lubricating oil composition of the present invention. However, the content is from 0.1 to 5% by mass, based on the total mass of the composition. When the lubricating oil composition of the present invention is used for an internal combustion engine, Component (C-1) is contained in an amount of preferably 0.1% by mass or less, more preferably 0.08% by mass or less in terms of phosphorus, based on the total mass of the composition considering of adverse affect on the exhaust-gas purifying device.

Component (C) is also preferably at least one kind of compound selected from (C-2) phosphorus compounds represented by formula (9) and/or (C-3) metal salts of phosphorus compounds represented by formulas (10) and (11):

(9)

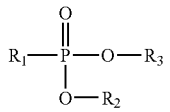

wherein $R_1$, $R_2$, and $R_3$ are each independently a hydrocarbon group which may contain oxygen and/or nitrogen, having 1 to 30 carbon atoms;

(10)

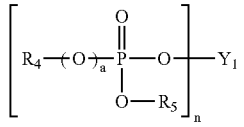

wherein $R_4$ and $R_5$ are each independently a hydrocarbon group which may contain oxygen and/or nitrogen, having 3 to 30 carbon atoms, $Y_1$ is metal, n is an integer corresponding to the valence of $Y_1$, and a is an integer of 0 or 1;

(11)

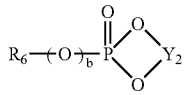

wherein $R_6$ is a hydrocarbon group which may contain oxygen and/or nitrogen, having 3 to 30 carbon atoms, $Y_2$ is metal, and b is an integer of 0 or 1.

Specific examples of hydrocarbon groups having 1 to 30 carbon atoms in formula (9) include alkyl, cycloalkyl, alkenyl, alkyl-substituted cycloalkyl, aryl, alkyl-substituted aryl, and arylalkyl groups. More specific examples include straight-chain or branched alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms, such as cyclopentyl, cyclohexyl, and cycloheptyl groups; alkylcycloalkyl groups having 6 to 10 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups, of which the alkyl groups may bond to any position of the cycloalkyl groups; straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl and nonadecenyl groups, the position of which the double bonds may vary; aryl groups such as phenyl and naphtyl groups; alkylaryl groups having 7 to 10 carbon atoms, such as tolyl, xylyl, ethylphenyl, propylphenyl, and butylphenyl groups, of which the alkyl groups may be straight-chain or branched and may bond to any position of the aryl groups; and arylalkyl groups having 7 to 10 carbon atoms, such as benzyl, phenylethyl, phenylpropyl, and phenylbutyl groups, of which the alkyl groups may be straight-chain or branched.

In formula (9), $R_1$ is preferably an alkyl or alkenyl group having 1 to 30, preferably 9 to 20, and particularly preferably 12 to 20 carbon atoms, and $R_2$ and $R_3$ are each preferably an alkyl or alkeny group having 1 to 30, preferably 1 to 8, more preferably 1 to 4 carbon atoms, and particularly preferably a methyl group.

Examples of phosphorus compounds represented by formula (9) include phosphonic diesters having 3 hydrocarbon groups having 1 to 30 carbon atoms. Specific examples include alkyl- or alkenylphosphonic dialkyl esters such as n-butylphosphonic di-n-butyl ester, isobutylphosphonic di-isobutyl ester, n-pentylphosphonic di-n-pentyl ester, n-hexylphosphonic di-n-hexyl ester, 1,3-dimethylbutylphosphonic di-1,3-dimethylbutyl ester, 4-methyl-2-pentylphosphonic di-4-methyl-2-pentyl ester, n-heptylphosphonic di-n-heptyl ester, n-octylphosphonic di-n-octyl ester, 2-ethylhexylphosphonic di-2-ethylhexyl ester, isodecylphosphonic di-isodecyl ester, n-dodecylphosphonic di-n-dodecyl ester, isotridecylphosphonic di-isotridecyl ester, oleylphosphonic di-oleyl ester, stearylphosphonic di-stearyl ester, octadecylphosphonic di-octadecyl ester, octadecylphosphonic di-methyl ester, octadecylphosphonic di-ethyl ester, octadecylphosphonic di-propyl ester, octadecylphosphonic methylethyl ester, octadecylphosphonic methylpropyl ester, octadecylphosphonic methylbutyl ester, oleylphosphonic di-methyl ester, and stearylphosphonic di-methyl ester; and mixtures thereof.

In the present invention, Components (C-2) can synergistically improve anti-friction properties when used in combination with Component (C-3). With the objective of low phosphorus content and ash content, Component (C-2) is a phosphonic diester preferably wherein $R_1$ is a hydrocarbon group having one or more carbon atoms, and $R_2$ and $R_3$ are each independently a hydrocarbon group having 1 to 30 carbon atoms and more preferably wherein $R_1$ is a hydrocarbon group having 10 to 30 and preferably 12 to 18 carbon atoms, and $R_2$ and $R_3$ are each independently a hydrocarbon group having 1 to 9, preferably 1 to 4 carbon atoms, and particularly preferably methyl.

Specific examples of hydrocarbon groups having 3 to 30 carbon atoms in formulas (10) and (11) include alkyl, cycloalkyl, alkenyl, alkylcycloalkyl, aryl, alkylaryl, and arylalkyl groups, all of which may contain oxygen and/or nitrogen.

Examples of alkyl groups include straight-chain or branched alkyl groups, such as propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of cycloalkyl groups include those having 5 to 7 carbon atoms, such as cyclopentyl, cyclohexyl, and cycloheptyl groups.

Examples of alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups, of which the alkyl groups may bond to any position of the cycloalkyl groups.

Examples of alkenyl groups include propenyl, butenyl, pentenyl, hexenyl, heptenyl, octenyl, noneyl, decenyl, undecenyl, dodecenyl, tridecenyl, tetradecenyl, pentadecenyl, hexadecenyl, heptadecenyl and octadecenyl groups, all of which may be straight-chain or branched and the position of which the double bonds may vary.

Examples of aryl groups include phenyl and naphthyl groups.

Examples of alkylaryl groups include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

The hydrocarbon groups having 3 to 30 carbon atoms are preferably alkyl or alkenyl groups having 3 to 18 carbon atoms, more preferably alkyl or alkenyl groups having 4 to 12 carbon atoms, further more preferably alkyl groups having 4 to 8 carbon atoms, and particularly preferably alkyl groups having 4 to 6 carbon atoms with the objective of excellent extreme pressure properties and anti-wear properties.

Examples of Component (C-3) include salts obtained by allowing a metal base such as a metal oxide, a metal hydroxide, a metal carbonate and a metal chloride to react with phosphoric esters or phosphonic esters each having one or two hydrocarbon groups having 3 to 30 carbon atoms, which may contain nitrogen and/or oxygen, so as to neutralize the whole or part of the remaining acid hydrogen.

Examples of phosphoric esters and phosphonic esters include phosphoric diesters, phosphonic monoesters and phosphonic monoesters having the above-exemplified hydrocarbon group having 3 to 30 carbon atoms, which may contain oxygen and/or nitrogen, or compounds of formulas (10) and (11) wherein —$(OR_{11})_n$— ($R_{11}$ is an alkylene group having 1 to 4, and n is an integer of 1 to 10) is inserted between the oxygen added to the hydrocarbon group having 3 to 30 carbon atoms, which may contain oxygen and/or nitrogen, and the phosphorus.

Preferred specific examples of Component (C-3) include metal salts of phosphoric mono- or di-n-butyl ester, phosphoric mono- or di-isobutyl ester, phosphoric mono- or di-n-pentyl ester, phosphoric mono- or di-n-hexyl ester, phosphoric mono- or di-1,3-dimethylbutyl ester, phosphoric mono- or di-4-methyl-2-pentyl ester, phosphoric mono- or di-n-heptyl ester, phosphoric mono- or di-n-octyl ester, phosphoric mono- or di-2-ethylhexyl ester, phosphoric mono- or diisodecyl ester, phosphoric mono- or di-n-dodecyl ester, phosphoric mono- or diisotridecyl ester, phosphoric mono- or dioleyl ester, phosphoric mono- or distearyl ester, phosphoric mono- or di-n-octadecyl ester, n-butylphosphonic mono-n-butyl ester, isobutylphosphonic monoisobutyl ester, n-pentylphosphonic mono-n-pentyl ester, n-hexylphosphonic mono-n-hexyl ester, 1,3-diemthylbutylphosphonic mono-1,3-dimethylbutyl ester, 4-methyl-2-pentylphosphonic mono-4-methyl-2-pentyl ester, n-heptylphosphonic mono-n-heptyl ester, n-octylphosphonic mono-n-octyl ester, 2-ethylhexylphosphonic mono-2-ethylhexyl ester, isodecylphosphonic monoisodecyl ester, n-dodecylphosphonic mono-n-dodecyl ester, isotridecylphosphonic monoisotridecyl ester, oleylphosphonic monooleyl ester, stearylphosphonic monostearyl ester, and n-octadecylphosphonic mono-n-octadecyl ester and also those containing different hydrocarbon groups in the molecule, such as metal salts of phosphoric butyl ester 2-ethylhexyl ester, phosphoric butyl ester oleyl ester, and oleylphosphonic monobutyl ester. Examples of metals of metal salts include alkali metals such as lithium, sodium, potassium, and cesium, alkaline earth metals such as calcium, magnesium, and barium, heavy metals such as aluminum, zinc, copper, iron, lead, nickel, silver, manganese, and molybdenum, and mixtures thereof. Among these metals, preferred are alkali metals, alkaline earth metals, zinc, copper, aluminum, and molybdenum, and particularly preferred are alkaline earth metals and zinc.

Since some compounds selected from Components (C-3) are insoluble or less soluble in a lubricating oil, it is particularly preferred with the objective of solubility of Component (C-3) and shortened production time of the lubricating oil composition that the compounds be presented as an oil-solved additive before it is blended to a lubricating base oil. No particular limitation is imposed on the method of rendering Component (C-3) oil soluble. Therefore, there may be employed a method wherein Component (C-3) is mixed with and dissolved in or reacted with an amine compound, for example, an ashless dispersant such as succinimide and/or a derivative thereof, an aliphatic amine, an aromatic amine and a polyamine, or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and then subjected to vacuum-distillation to remove the solvent; methods similar thereto; or other known methods.

No particular limitation is imposed on the content of Component (C-2) in the lubricating oil composition of the present invention. However, the lower limit content is generally 0.001% by mass, preferably 0.01% by mass, and more preferably 0.02% by mass in terms of phosphorus based on the total mass of the composition. The upper limit is not limited, either. Therefore, the lubricating oil additive composition containing Component (C-2) in a higher concentration may be provided. However, the upper limit is generally 0.2% by mass, preferably 0.1% by mass, more preferably 0.08% by mass, and particularly preferably 0.05% by mass in terms of phosphorus based on the total mass of the composition. Component (C-2) of the lower limit or more can provide the resulting lubricating oil composition with excellent extreme pressure properties and anti-wear properties, while Component (C-2) of the upper limit or less can achieve the decrease of phosphorus content of the lubricating oil composition.

Particularly when the lubricating oil composition of the present invention is used for an internal combustion engine, Component (C-2) of 0.08% by mass or less, particularly 0.05% by mass or less is contributive to the production of a low phosphorus type lubricating oil composition which is extremely less in adverse affects on the exhaust-gas purifying device.

No particular limitation is imposed on the content of Component (C-3) in the lubricating oil composition of the present invention. However, the lower limit content is generally 0.001% by mass, preferably 0.01% by mass, and more preferably 0.02% by mass in terms of phosphorus based on the total mass of the composition. The upper limit is not limited, either. Therefore, the lubricating oil additive composition containing Component (C-3) in a higher concentration may be provided. However, the upper limit is generally 0.2% by mass, preferably 0.1% by mass, more preferably 0.08% by mass, and particularly preferably 0.05% by mass in terms of phosphorus based on the total mass of the composition. Component (C-3) of the lower limit or more can provide the resulting lubricating oil composition with excellent extreme pressure properties and anti-wear properties, while Component (C-3) of the upper limit or less can achieve the decrease of phosphorus content of the lubricating oil composition. Particularly when the lubricating oil composition of the present invention is used for an internal combustion engine, Component (C-3) of 0.08% by mass or less, particularly 0.05% by mass or less is contributive to the production of a low phosphorus type lubricating oil composition which is extremely less in adverse affects on the exhaust-gas purifying device.

There is no particular restriction on the content ratio of Components (C-2) and (C-3) when they are used in combination. The ratio is preferably from 10:90 to 90:10, more preferably 20:80 to 80:20, even more preferably 30:70 to 70:30, and particularly preferably 40:60 to 60:40 by mass in terms of phosphorus contained in each component. The anti-wear properties of the lubricating oil composition of the present invention can be synergistically improved by the content ratio of Components (C-2) and (C-3) in the above range.

There is no particular restriction on the total content of Components (C-2) and (C-3) when they are used in combination. However, the lower limit content is generally 0.001% by mass, preferably 0.01% by mass, and further more preferably 0.02% by mass in terms of phosphorus based on the total mass of the composition. The upper limit is not limited, either. Therefore, the lubricating oil additive composition containing Components (C-2) and (C-3) at a higher concentration may be provided. However, the upper limit is generally 0.2% by mass, preferably 0.1% by mass, more preferably 0.08% by mass, and particularly preferably 0.05% by mass in terms of phosphorus based on the total mass of the composition. Components (C-2) and (C-3) of the lower limit or more can provide the resulting lubricating oil composition with excellent extreme pressure properties and anti-wear properties. Furthermore, Components (C-2) and (C-3) of the upper limit or less can decrease the phosphorus content of the resulting lubricating oil composition. Particularly when a lubricating oil composition containing Components (C-2) and (C-3) of the upper limit or less is used as an internal combustion engine, it is possible to achieve the further decrease of the phosphorus content of the composition due to expected synergistic effects of Components (C-2) and (C-3) and provide a low phosphorus type lubricating oil composition which is extremely less in adverse affect on the exhaust gas purifying device with 0.08% by mass or less, particularly 0.05% by mass or less of Components (C-2) and (C-3).

The lubricating oil composition of the present invention preferably further contains (D) an ashless dispersant and/or (E) an antioxidant.

Component (D), i.e., ashless dispersant may be any of those used in lubricating oils, such as nitrogen-containing compounds having at least one straight-chain or branched alkyl or alkenyl group having 40 to 400 carbon atoms in the molecules and derivatives thereof, and modified products of alkenyl succinimides. A mixture of any one or more of these compounds may be blended with the lubricating oil composition of the present invention.

The carbon number of the alkyl or alkenyl group is preferably from 40 to 400 and preferably from 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (D) include the following compounds one or more of which may be used:

(D-1) succinimides having in their molecules at least one alkyl or alkenyl group having 40 to 400 carbon atoms and derivatives thereof; (D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (17) and (18):

(17)

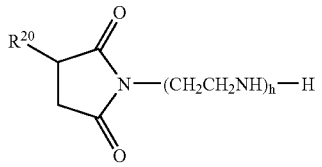

wherein $R^{20}$ is an alkyl or alkenyl group having 40 to 400 and preferably 60 to 350 carbon atoms, and h is an integer of 1 to 5, preferably 2 to 4; and (18)

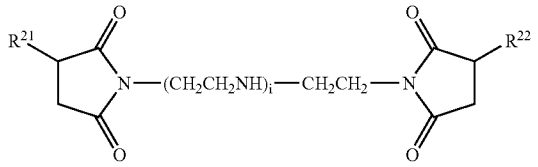

wherein $R^{21}$ and $R^{22}$ are each independently an alkyl or alkenyl group having 40 to 400, preferably 60 to 350 carbon atoms, and particularly preferably a polybutenyl group, and i is an integer of 0 to 4, preferably 1 to 3.

Succinimides include mono-type succinimides wherein a succinic anhydride is added to one end of a polyamine, as represented by formula (17) and bis-type succinimides wherein a succinic anhydride is added to both ends of a polyamine, as represented by formula (18). The lubricating oil composition may contain either type of the succinimides or mixtures thereof.

There is no particular restriction on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (D-2) benzylamines include compounds represented by formula (19):

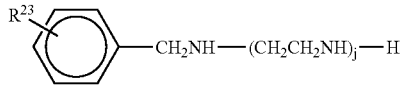

(19)

wherein $R^{23}$ is an alkyl or alkenyl group having 40 to 400 and preferably 60 to 350 carbon atoms, and j is an integer of 1 to 5, preferably 2 to 4.

There is no particular restriction on the method for producing the benzylamines. They may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D-3) polyamines include compounds represented by formula (20):

$$R^{24}—NH—(CH^2CH^2NH)_k—H \quad (20)$$

wherein $R^{24}$ is an alkyl or alkenyl group having 40 to 400 and preferably 60 to 350, and k is an integer of 1 to 5 and preferably 2 to 4.

There is no particular restriction on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Specific examples of the derivatives of the nitrogen-containing compounds exemplified as an example of Component (D) include (i) an acid-modified compound obtained by allowing any of the above-described nitrogen-containing compounds to react with a monocarboxylic acid having 1 to 30 carbon atoms, such as fatty acid or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; (ii) a boron-modified compound obtained by allowing any of the above-described nitrogen-containing compounds to react with boric acid so as to neutralize or amidize the whole or part of the remaining amino and/or imino groups; (iii) a sulfur-modified compound obtained by allowing any of the above-described nitrogen-containing compounds to react with a sulfuric compound; and (iv) modified products obtained by a combination of two or more selected from the modifications with acid, boron, and sulfur, of the above-described nitrogen-containing compounds. Among these derivatives, boron-modified compounds of alkenylsuccinimides are excellent in heat resistance and antioxidation properties and thus effective for further enhancing the base number retention properties and high-temperature detergency of the resulting lubricating oil composition of the present invention.

When the lubricating oil composition of the present invention contains Component (D), the content thereof is from 0.01 to 20% by mass and preferably 0.1 to 10% by mass based on the total mass of the composition. Component (D) of less than 0.01% by mass is less effective in high temperature detergency, while Component (D) of more than 20% by mass deteriorates extremely the low temperature fluidity of the resulting lubricating oil composition.

Component (E) may be any conventional antioxidant such as phenol-based antioxidants, amine-based antioxidants, and metal antioxidants, which are generally used in a lubricating oil. Addition of an antioxidant can enhance the antioxidation properties of a lubricating oil composition and thus enhance the base number retention properties and high-temperature detergency of the lubricating oil composition of the present invention.

Examples of phenol-based antioxidants include
4,4'-methylenebis(2,6-di-tert-butylphenol),
4,4'-bis(2,6-di-tert-butylphenol),
4,4'-bis(2-methyl-6-tert-butylphenol),
2,2'-methylenebis(4-ethyl-6-tert-butylphenol),
2,2'-methylenebis(4-methyl-6-tert-butylphenol),
4,4'-butylidenebis(3-methyl-6-tert-butylphenol),
4,4'-isopropylidenebis(2,6-di-tert-butylphenol),
2,2'-methylenebis(4-methyl-6-nonylphenol),
2,2'-isobutylidenebis(4,6-dimethylphenol),
2,2'-methylenebis(4-methyl-6-cyclohexylphenol),
2,6-di-tert-butyl-4-methylphenol,
2,6-di-tert-butyl-4-ethylphenol,
2,4-dimethyl-6-tert-butylphenol, 2,6-di-tert-α-dimethylamino-p-cresol,
2,6-di-tert-butyl-4(N,N'-dimethylaminomethylphenol),
4,4'-thiobis(2-methyl-6-tert-butylphenol),
4,4'-thiobis(3-methyl-6-tert-butylphenol),
2,2'-thiobis(4-methyl-6-tert-butylphenol),
bis(3-methyl-4-hydroxy-5-tert-butylbenzyl) sulfide,
bis(3,5-di-tert-butyl-4-hydroxybenzyl)sulfide,
2,2'-thio-diethylenebis[3-(3,5-di-tert-butyl-4-hydroxyphenyl)propionate],
tridecyl-3-(3,5-di-tert-butyl-4-hydroxyphenyl) propionate,
pentaerythrityl-tetraquis[3-(3,5-di-tert-butyl-4-hydroxyphenyl)propionate],
octyl-3-(3,5-di-tert-butyl-4-hydroxyphenyl) propionate,
octadecyl-3-(3,5-di-tert-butyl-4-hydroxyphenyl)propionate and
octyl-3-(3-methyl-5-tert-butyl-4-hydroxyphenyl propionate.

Mixtures of two or more of these compounds may be used.

Examples of amine-based antioxidants include phenyl-α-naphtylamines, alkylphenyl-α-naphtylamines, and dialkyldiphenylamines. A mixture of two or more of these antioxidants may be blended.

These phenol-based and amine-based antioxidants may be used in combination.

The content of Component (E) in the lubricating oil composition is preferably 5.0% by mass or less, more preferably 3.0% by mass or less, and further more preferably 2.5% by mass or less based on the total mass of the composition. Component (E) of more than 5.0% by mass fails to obtain sufficient antioxidation properties as balanced with the content. The content of Component (E) is 0.1% by mass or more and more preferably 1% by mass or more based on the total mass of the composition.

In order to further enhance the performance characteristics of the lubricating oil composition of the present invention, it may be blended with any of additives which have been used in lubricating oils, depending on purposes. Examples of such additives include friction modifiers other than Component (A), anti-wear agents other than Components (B) and (C), metallic detergents, viscosity index improvers, corrosion inhibitors, rust inhibitors, demulsifiers, metal deactivators, anti-foaming agents, and dyes.

Friction modifiers other than Component (A) may be any of compounds which are generally used as a friction modifier for a lubricating oil. Examples of such friction modifiers include ashless friction modifiers such as amine compounds, fatty acid esters, fatty acid amides, fatty acids, aliphatic alcohols, and aliphatic ethers, each having in their molecules at least one alkyl or alkenyl group, particularly straight-chain alkyl or alkenyl group having 6 to 30 carbon atoms; and molybdenum-based friction modifiers such as sulfur-containing molybdenum complexes such as molybdenum dithiocarbamate and molybdenum dithiophosphate, sulfur-free organic molybdenum complexes such as molybdenum amine complexes and molybdenum-succinimide complexes, and molybdenum disulfide. The content of these friction modifiers is usually from 0.1 to 5% by mass, based on the mass of the lubricating oil composition.

Examples of anti-wear agents other than Components (B) and (C) include sulfur-containing compounds such as disulfides, olefin sulfides, sulfurized fats and oils and dithiocarbamate and phosphorus- and sulfur-containing compounds such as derivatives of dithiophosphoric esters (β-dithiophosphorylated propionic acid, olefin cyclopentadiene adducts, (methyl)methacryl acid adduct, derivatives thereof, and mixtures thereof). These anti-wear agents may be contained in an amount of 0.005 to 5% by mass, based on the mass of the lubricating oil composition.

Examples of metallic detergents include alkali metal or alkaline earth metal sulfonates, alkali metal or alkaline earth metal phenates, alkali metal or alkaline earth metal salicylates, and mixtures thereof.

The alkali metal or alkaline earth metal sulfonates, alkali metal or alkaline earth metal phenates, and alkali metal or alkaline earth metal salicylates include neutral salts (normal salts) obtained by reacting alkyl aromatic sulfonic acids, alkylphenols, alkylphenolsulfides, Mannich reaction products of alkylphenols or alkylsalicylic acids directly with a metallic base such as an alkali metal or alkaline earth metal oxide or hydroxide or obtained by converting alkyl aromatic sulfonic acids, alkylphenols, alkylphenolsulfides, Mannich reaction products of alkylphenols or alkylsalicylic acids to alkali metal salts such as sodium salts and potassium salts, followed by substitution with an alkaline earth metal salt; basic salts obtained by heating these neutral salts with an excess amount of an alkali metal or alkaline earth metal salt or an alkali metal or alkaline earth metal base (alkali metal or alkaline earth metal hydroxide or oxide) in the presence of water; and overbased salts (superbasic salts) obtained by reacting these neutral salts with a base such as an alkali metal or alkaline earth metal hydroxide in the presence of carbonic acid gas, or boric acid or boric acid salt. These reactions are generally carried out in a solvent (aliphatic hydrocarbon solvents such as hexane, aromatic hydrocarbon solvents such as xylene, and light lubricating base oil).

Although metallic detergents are usually commercially available as diluted with a light lubricating base oil, it is preferred to use metallic detergents whose metal content is within the range of 1.0 to 20% by mass and preferably 2.0 to 16% by mass. The base number of metallic detergents is usually 0 to 500 mgKOH/g and more preferably 20 to 450 mgKOH/g. The term "base number" used herein denotes a base number measured by the perchloric acid potentiometric titration method in accordance with section 7 of JIS K2501 "Petroleum products and lubricants-Determination of neutralization number".

One or more of alkali metal or alkaline earth metal sulfonates, phenates, and salicylates may be used in the present invention. It is particularly preferred to use alkali metal or alkaline earth metal salicylates because of their extremely excellent friction reducing effect and long-drain properties.

There is no particular restriction on the content of the metallic detergent. The metallic detergent is usually contained in an amount of 0.01 to 5% by mass in terms of metal, based on the total amount of the composition. Furthermore, the content of the metallic detergent is preferably so adjusted in combination with the contents of other additives that the sulfated ash content of a composition is made 1.0% by mass or less. From that point of view, the upper limit content of the metallic detergent is preferably 0.3% by mass, more preferably 0.2% by mass in terms of metal, while the lower limit content is preferably 0.02% by mass, more preferably 0.05% by mass, based on the total mass of the composition. The sulfated ash content used herein denotes a value measured by a method described by "Testing Methods for Sulfated Ash" stipulated in JIS K 2272 5. and mainly results from metal-containing additives.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or the hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount. The content of the viscosity index improver is generally from 0.1 to 20% by mass, based on the total mass of the composition.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of each of the corrosion inhibitor, rust inhibitor, and demulsifier is selected from 0.005 to 5% by mass based on the total mass of the composition. The content of the metal deactivator is selected from 0.005 to 1% by mass, while the content of the anti-foaming agent is selected from 0.0005 to 1% by mass.

The lubricating oil composition of the present invention is preferably liquid at ordinary temperature, for example from 5 to 30° C. The sulfated ash content of the lubricating oil composition is preferably 1% by mass or less, while the phosphorus content is 0.08% by mass or less. The content of the effective component of sulfur-containing additive is preferably 0.15% by mass or less in terms of sulfur, based on the total mass of the composition.

The lubricating oil composition blended with the lubricating oil additive of the present invention is more excellent in friction reducing effect than that containing a conventional ashless friction modifier. The lubricating oil composition containing a metal salt of a sulfur-free phosphorus compound is excellent in long-drain capability (oxidation stability, base number retention properties) and high-temperature detergency and preferably used for internal combustion engines such as gasoline engines, diesel engines and gas engines of motorcycles, automobiles, power generators, and ships. The lubricating oil composition is particularly suitable for internal combustion engines equipped with an exhaust-gas after-treatment device. Among these engines, the composition is preferably used in those whose valve mechanism is direct strike type or roller follower type, and particularly suitable for roller follower type. The lubricating oil composition of the present invention is particularly preferably used as a lubricating oil for an internal combustion engine, particularly a gasoline or gas engine, using a low sulfur fuel whose sulfur content is 50 ppm by mass or less, preferably 30 ppm by mass or less, and particularly preferably 10 ppm by mass or less, such as gasoline, gas oil, or kerosene; a fuel whose sulfur content is 1 ppm by mass or less, such as LPG and natural gas; or a substantially sulfur-free fuel such as hydrogen, dimethylether, alcohols, and GTL (Gas to Liquid) fuel.

When the lubricating oil composition of the present invention is used for internal combustion engines, the base oil, lubricating oil additives, and dilution oil contained therein is preferably selected such that the sulfur content of the composition can be adjusted to 0.3% by mass or less, preferably 0.2% by mass or less, more preferably 0.15% by mass or less, even more preferably 0.1% by mass or less, and particularly preferably 0.05% by mass or less, thereby significantly reducing the sulfur poisoning of the exhaust-gas purifying catalyst of the internal combustion engine.

The internal combustion engines are preferably those having an exhaust-gas treatment system which is a combination of one or more kinds selected from a ternary catalyst, an oxidation catalyst and a NOx adsorber and DPF.

Moreover, the lubricating oil composition of the present invention is suitably used as a lubricating oil required to possess the above-described low friction properties, such as those for driving systems of automatic or manual transmissions, greases, wet brake oils, hydraulic oils, turbine oils, compressor oils, bearing oils, refrigerating oils, or the like.

APPLICABILITY IN THE INDUSTRY

According to the present invention, there are provided a lubricating oil additive excellent in friction reducing effect and a lubricating oil composition containing such an additive, particularly suitable for fuel efficient internal combustion engines.

BEST MODES FOR CARRYING OUT THE INVENTION

Hereinafter, the present invention will be described in more details by way of the following examples and comparative examples, which should not be construed as limiting the scope of the invention.

Examples 1 and 2, Reference Examples 1 and 2, and Oil for Criterion

There were prepared lubricating oil compositions containing Component (A1) as (A) nitrogen-containing compound of the present invention (Examples 1 and 2), those containing other ashless friction modifiers (Reference Examples 1 and 2), and that containing no ashless dispersant (oil of criterion), in accordance with the formulations set forth in Table 1.

The compositions thus obtained were subjected to LFW-1 boundary friction test under the conditions of load (average Hertz pressure) of 100 lbs (299 Mpa), oil temperature of 100° C., and sliding velocity of 50 to 100 mm/s to measure the friction coefficient. The friction reduction rate (%) of each of the compositions to the criterion oil was calculated from the measured friction coefficient.

As apparent from the results set forth in Table 1, the lubricating oil composition containing the nitrogen-containing compound of the present invention exhibited significantly excellent friction reducing effect. The composition containing zinc dialkylphosphate had excellent long drain capability such as oxidation stability and base number retention properties, compared with that containing zinc dialkyldithiophosphate, and can maintain the friction reducing effect for a long period of time not only when it is fresh.

Examples 3 and 4, Reference Examples 3 to 6, and Oil for Criterion

There were prepared lubricating oil compositions containing Component (A-2) as (A) nitrogen-containing compound (Examples 3 and 4) of the present invention, those containing other ashless friction modifiers (Reference Examples 3 to 6), and that containing no ashless dispersant (oil of criterion), in accordance with the formulations set forth in Table 2. The compositions of Examples 3 and 4 were liquid at 0° or lower and thus had viscosity-temperature properties enabling the composition to be used as an ordinary engine oil.

The compositions thus obtained were subjected to LFW-1 boundary friction test under the conditions of load (average Hertz pressure) of 100 lbs (299 Mpa), oil temperature of 100° C., and sliding velocity of 50 to 100 mm/s to measure the friction coefficient. The friction reduction rate (%) of each of the compositions to the criterion oil was calculated from the measured friction coefficient.

As apparent from the results set forth in Table 2, the lubricating oil composition containing the nitrogen-containing compound of the present invention exhibited significantly excellent friction reducing effect. The composition containing zinc alkylphosphate had excellent long drain capability such as oxidation stability and base number retention properties, compared with that containing zinc alkyldithiophosphate, and can maintain the friction reducing effect for a long period of time not only when it is fresh.

Example 5, Reference Examples 7 and 8, and Oil for Criterion

There were prepared a lubricating oil composition containing Component (A-3) as (A) nitrogen-containing compound (Example 5) of the present invention, those containing other ashless friction modifiers (Reference Examples 7 and 8), and that containing no ashless dispersant (oil of criterion), in accordance with the formulations set forth in Table 3. The composition of Example 5 was liquid at 0° C. or lower and thus had viscosity-temperature properties enabling the composition to be used as an ordinary engine oil.

The compositions thus obtained were subjected to LFW-1 boundary friction test under the conditions of load (average Hertz pressure) of 100 lbs (299 Mpa), oil temperature of 100° C., and sliding velocity of 50 to 100 mm/s to measure the friction coefficient. The friction reduction rate (%) of each of the compositions to the criterion oil was calculated from the measured friction coefficient.

As apparent from the results set forth in Table 3, the lubricating oil composition containing the nitrogen-containing compound of the present invention exhibited significantly excellent friction reducing effect. The composition containing zinc alkylphosphate had excellent long drain capability such as oxidation stability and base number retention properties, compared with that containing zinc alkyldithiophosphate, and can maintain the friction reducing effect for a long period of time not only when it is fresh.

Example 6, Reference Examples 9 to 11, and Oil for Criterion

There were prepared a lubricating oil composition containing Component (A-3) as (A) nitrogen-containing compound (Example 6) of the present invention, those containing other ashless friction modifiers (Reference Examples 9 to 11), and that containing no ashless dispersant (oil of criterion), in accordance with the formulations set forth in Table 4. The composition of Example 6 was liquid at 0° C. or lower and thus had viscosity-temperature properties enabling the composition to be used as an ordinary engine oil.

The compositions thus obtained were subjected to LFW-1 boundary friction test under the conditions of load (average Hertz pressure) of 100 lbs (299 Mpa), oil temperature of 100° C., and sliding velocity of 50 to 100 mm/s to measure the friction coefficient. The friction reduction rate (%) of each of the compositions to the criterion oil was calculated from the measured friction coefficient.

As apparent from the results set forth in Table 4, the lubricating oil composition containing the nitrogen-containing compound of the present invention exhibited significantly excellent friction reducing effect. The composition containing zinc alkylphosphate had excellent long drain capability such as oxidation stability and base number retention properties, compared with that containing zinc alkyldithiophosphate, and can maintain the friction reducing effect for a long period of time not only when it is fresh.

Examples 7 to 21

Example 7

To toluene were added and mixed (a) 10 g of (A-7) oleic hydrazide represented by formula (21) below and (b) 20 g of zinc di-2-ehtylhexyldithiophosphate. After the mixture was mixed and stirred at a temperature of 100° C. for 30 minutes, the toluene was distilled thereby obtaining an oil soluble metal complex 1.

(21)

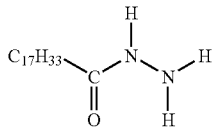

Example 8

To toluene were added and mixed (a) 10 g of (A-7) oleic hydrazide same as the above, (b) 20 g of zinc dibutylphosphate, and (c) 10 g of dodecyldimethylamine. After the mixture was mixed and stirred at a temperature of 100° C. for 30 minutes, the toluene was distilled thereby obtaining an oil soluble metal complex 2.

Example 9

(a) 10 g of (A-7) oleic hydrazide same as the above, (b) 10 g of zinc dibutylphosphate, and (c) a mixture of 20 g of oleylamine and 10 g of alkyldiphenylamine were mixed and stirred at a temperature of 100° C. for 30 minutes, thereby obtaining an oil soluble metal complex 3.

Example 10

(a) 10 g of (A-7) oleic hydrazide same as the above, (b) 20 g of zinc dibutyldithiocarbamate, and (c) a mixture of 10 g of oleylamine and 20 g of 150N mineral oil were mixed and stirred at a temperature of 100° C. for 30 minutes, thereby obtaining an oil soluble metal complex 4.

Example 11

(a) 10 g of (A-7) oleic hydrazide same as the above, (b) 20 g of zinc dibutylphosphate, and (c) a mixture of 80 g of polybutenyl succinimide (Mw of PIB group: 1000, N content: 2.3% by mass) and 20 g of 150N mineral oil were mixed and stirred at a temperature of 100° C. for 30 minutes, thereby obtaining an oil soluble metal complex 5.

Example 12

(a) 10 g of (A-7) oleic hydrazide same as the above, (b) 20 g of zinc naphthenate, and (c) a mixture of 80 g of polybutenyl succinimide (Mw of PIB group: 1000, N content: 2.3% by mass) and 20 g of 150N mineral oil were mixed and stirred at a temperature of 100° C. for 30 minutes, thereby obtaining an oil soluble metal complex 6.

Example 13

(a) 10 g of (A-7) oleic hydrazide same as the above, (b) 20 g of zinc salt of 2-ethylhexyl phosphonic mono-2-ethylhexyl ester, and (c) a mixture of 80 g of polybutenyl succinimide (Mw of PIB group: 1000, N content: 2.3% by mass) and 20 g of 150N mineral oil were mixed and stirred at a temperature of 120° C. for 30 minutes, thereby obtaining an oil soluble metal complex 7.

Example 14

(a) 10 g of (A-1) oleyl semicarbazide (oleyl carbazinamide) represented by formula (22) below and (b) a mixture of 20 g of zinc di-2-ethylhexyldithiophosphate and 20 g of a hydro-refined mineral oil were mixed and stirred at a temperature of 100° C. for 30 minutes, thereby obtaining an oil soluble metal complex 8.

(22)

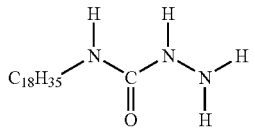

Example 15

(a) 10 g of (A-1) oleyl semicarbazide same as the above, (b) 20 g of zinc dibutylphosphate, and (c) a mixture of 10 g of dodecyldimethylamine and 10 g of dialkyldiphenylamine were mixed and stirred at a temperature of 100° C. for 30 minutes, thereby obtaining an oil soluble metal complex 9.

Example 16

(a) 10 g of (A-1) oleyl semicarbazide same as the above, (b) 10 g of zinc dibutylphosphate, and (c) a mixture of 10 g of oleylamine and 20 g of a 150N mineral oil were mixed and stirred at a temperature of 100° C. for 30 minutes, thereby obtaining an oil soluble metal complex 10.

Example 17

(a) 10 g of (A-1) oleyl semicarbazide same as the above, (b) 20 g of zinc dibutyldithiocarbamate, and (c) a mixture of 10 g of oleylamine and 20 g of a 150N mineral oil were mixed and stirred at a temperature of 100° C. for 30 minutes, thereby obtaining an oil soluble metal complex 11.

Example 18

To toluene were added and mixed (a) 10 g of (A-1) oleyl semicarbazide same as the above, (b) 20 g of zinc dibutylphosphate, and (c) 80 g of polybutenyl succinimide (Mw of PIB group: 1000, N content: 2.3% by mass). After the mixture was mixed and stirred at a temperature of 100° C. for 30 minutes, the toluene was distilled thereby obtaining an oil soluble metal complex 12.

Example 19

To toluene were added and mixed (a) 10 g of (A-1) oleyl semicarbazide same as the above, (b) 20 g of zinc naphthenate, and (c) 80 g of polybutenyl succinimide (Mw of PIB group: 1000, N content: 2.3% by mass). After the mixture was mixed and stirred at a temperature of 100° C. for 30 minutes, the toluene was distilled thereby obtaining an oil soluble metal complex 13.

Example 20

A mixture of (a) 10 g of (A-1) oleyl semicarbazide same as the above, (b) 20 g of zinc naphthenate, and (c) a mixture of 80 g of polybutenyl succinimide (Mw of PIB group: 1000, N content: 2.3% by mass) and 20 g of a 150N mineral oil were mixed and stirred at a temperature of 100° C. for 30 minutes, thereby obtaining an oil soluble metal complex 14.

Example 21

(a) 5 g of (A-7) oleic hydrazide same as the above, (b) 6 g of zinc dibutylphosphate, and (c) a mixture of 80 g of polybutenyl succinimide (Mw of PIB group: 1000, N content: 2.3% by mass), 60 g of calcium salicylate (base number: 170 mgKOH/g, Ca content: 6% by mass), and 20 g of an antioxidant (phenol-based and amine-based) were mixed and stirred at a temperature of 100° C. for 30 minutes, thereby obtaining an oil soluble metal complex 15.

Examples 22 to 36 and Reference Examples 12 to 26

Each of the oil soluble metal complexes 1 to 15 (Examples 7 to 21) obtained above was added in an amount set forth in Table 5 to a base oil and mixed and stirred at a temperature of 40° C. to observe how the metal complex was dissolved in the base oil after 30 minutes, one hour, 5 hours, and 10 hours from the beginning of stirring (Examples 22 to 36).

For comparison, Components (a), (b) and (C) individually or in combination were added in an amount set forth in Table 6 to a base oil and mixed and stirred at a temperature of 40° C. to observe how the metal complex was dissolved in the base oil after 30 minutes, one hour, 5 hours, and 10 hours from the beginning of stirring (Reference Examples 12 to 26).

As shown in Table 5, it was confirmed that the oil soluble complexes of the present invention and lubricating oil additives containing the same were excellent in oil solubility in a base oil at a relatively low temperature such as 40° C. and were completely dissolved after 30 minutes (Examples 22 to 26). It is therefore confirmed that the oil soluble metals complexes can improve the handling of a lubricating oil additive, resulting in the quick production of a lubricating oil additive or lubricating oil composition.

Whereas, even when Components (a), (b) and (C) individually or in combination were added in a base oil and mixed and stirred at a temperature of 40° C. for 10 hours, no insoluble disappeared. It is assumed that this is because any metal complex was not formed or it took a considerably long time to form such a metal complex.

Example 37, Reference Examples 27 to 29, and Oil for Criterion

There were prepared a lubricating oil composition containing Component (A-7) as (A) nitrogen-containing compound of the present invention and (C) a phosphorus compound other than zinc dithiophosphate (Example 37), that containing Component (A-7) and zinc dithiophosphate (Reference Example 27), that containing a fatty acid amide friction modifier and Component (C) (Reference Example 28), that containing a fatty acid amide friction modifier and zinc dithiophosphate (Reference 29), and that containing zinc dithiophosphate but no friction modifier (oil for criterion), in accordance with the formulations set forth in Table 7.

The compositions thus obtained were subjected to LFW-1 boundary friction test under the conditions of load (average Hertz pressure) of 100 lbs (299 Mpa), oil temperature of 100°

C., and sliding velocity of 50 to 100 mm/s to measure the friction coefficient. The friction reduction rate (%) of each of the composition to the criterion oil was calculated from the measured friction coefficient.

As apparent from the results set forth in Table 7, the composition containing Component (A-7) as (A) specific nitrogen-containing compound of the present invention and (C) a phosphorus compound other than zinc dithiophosphate exhibited a significantly excellent friction reducing effect. Whereas, the compositions of Reference Examples 27 and 29 were poor in friction reducing effect. From the results of Reference Examples 27 and 29, it is apparent that Component (A-7) in combination with zinc dithiophosphate was less in friction reducing effect than that of a fatty acid amide friction modifier. The composition of Reference Example 28 was excellent in friction reducing effect but inferior in friction reducing rate to the composition of Example 37. The friction modifier varied in effect depending on whether it was used in combination with zinc dithiophosphate or Component (C). The composition of Example 37 has an excellent long-drain capability such as oxidation stability and base number retention properties, compared with Reference Example 27 and thus can maintain the friction reducing effect for a long period of time not only when it is fresh.

Examples 38 to 40, Reference Example 30, and Oil for Criterion

There were prepared lubricating oil compositions of the present invention (Examples 38 to 40), that for reference (Reference Example 30), and criterion oil containing zinc dithiophosphate, in accordance with the formulations set forth in Table 8. The compositions thus obtained were subjected to the following performance evaluation tests (1) and (2) The results are also set forth in Table 8.

(1) High-Speed Four-Balls Test

Each of the compositions was subjected to a high-speed four-ball test in accordance with ASTM D2783-88 at room temperature and a rotation speed of 1,800 rpm while the load on four balls is constantly increased. The load (LNSL, last non-seize load) at which wear occurred on the balls was measured. A higher LNSL value indicates that the composition is excellent in anti-wear properties and extreme pressure properties.

(2) LFW-1 Boundary Friction Test

The compositions thus obtained were subjected to LFW-1 boundary friction test under the conditions of load (average Hertz pressure) of 100 lbs (299 Mpa), oil temperature of 100° C., and sliding velocity of 50 to 100 mm/s to measure the friction coefficient. The friction reduction rate (%) of each of the composition to the criterion oil was calculated from the measured friction coefficient.

As apparent from the results in Table 8, the compositions containing Component (A-7) as (A) nitrogen-containing compound of the present invention and (C) a phosphorus compound other than zinc dithiophosphate (Examples 38 to 40) exhibited a significantly excellent friction reducing effect. Particularly, the composition of Example 38 containing Components (A), (C-2) and (C-3) in combination and sulfur and phosphorus in amounts of 0.05% by mass or less and 0.08% by mass or less, respectively exhibited excellent anti-wear properties and friction reducing effect, compared with the composition containing Components (C-2) and (C-3) in combination (Reference Example 30), that containing Components (C-3) and (A) in combination (Example 39), and that containing Components (C-2) and (A) in combination (Example 40).

Examples 41 and 42

Into a flask were charged 0.5 mol % (148.25 g) of (A-7) oleic hydrazide ($C_{17}H_{33}$—C(=O)—NH—$NH_2$) as (A) the nitrogen-containing compound of the present invention, 0.5 mol % of boric acid, and 500 ml of toluene, and then about 3 mol (54.3 g) of water. The mixture was reacted at a temperature of 90° C. for 3 hours, and then heated at a temperature of 115° C. to distill out the water. Thereafter, the toluene layer was cooled to room temperature such that the white crystal was precipitated. The white crystal was vacuum-filtrated through a glass filter. The resulting white crystal was washed with toluene and methanol at room temperature so as to distill out the solvent adhered to the crystal, thereby obtaining the intended Component (A-5), i.e., hydrazide derivative (white crystal).

There was obtained a lubricating oil composition (Example 41) using (A-5) hydrazide derivative, in accordance with the formulation set forth in Table 9. There was also obtained a lubricating oil composition containing (A-7) a non-acid-modified hydrazide compound (Example 42). These composition was subjected to the following performance evaluation tests. The results are also set forth in Table 9.

(1) Base Number Remaining Rate After Deterioration Test by ISOT

Each of the compositions was forced to deteriorate at a temperature of 165.5° C. by an ISOT test in accordance with JIS K 2514 so as to measure the base number remaining rate (hydrochloric acid method) after 96 hours. Before the test, copper and iron pieces had been put into the composition as catalysts. A higher base number remaining rate against the testing time indicates that the composition is enhanced in base number retention properties and thus is a long drain oil which is able to be used for a long period of time.

(2) Copper Elusion Amount After the Deterioration Test by ISOT

The amount of copper elusion in each composition was measured after the ISOT test.

(3) High-Temperature Detergency Evaluated by hot Tube Test

The hot tube test was conducted at a temperature of 310° C. in accordance with JPI-5S-5599. Each of the compositions was rated from 10 to 0. A rating of 10 indicates colorless and transparent (no deposit) and a rating of 0 point indicates black and opaque. Between 10 and 0, evaluation was done using reference tubes which were made per grade beforehand. At 290° C., a rating of 6 or greater indicates that the composition is considered as a lubricating oil with excellent detergency for an ordinary gasoline or diesel engine.

(4) Valve Train Wear Test

Each of the compositions was also subjected to a valve train wear test in accordance with JASO M 328-95 to measure the amount of wear produced at the cam nose after the lapse of 100 hours. If the cam nose wear amount is 50 μm or less and 10 μm or less, the composition is excellent and extremely excellent in anti-wear properties. The test fuel was a sulfur-free gasoline whose sulfur content was 10 ppm by mass or less.

As apparent from the results in Table 9, the lubricating oil composition containing (A-7) hydrazide derivative as (A) a nitrogen-containing compound of the present invention and zinc dialkylphosphate (Example 42) was excellent all in base number retention properties, copper elusion properties, high-temperature detergency, and anti-wear properties. Furthermore, the composition containing (A-5) an acid-modified derivative of a hydrazide compound as (A) a nitrogen-containing compound of the present invention (Example 41) was more excellent in base number retention properties, copper elusion preventing properties, high-temperature detergency, and anti-wear properties than the composition of Example 42.

TABLE 1

| | | Example 1 | Example 2 | Reference Example 1 | Reference Example 2 | Criterion Oil |
|---|---|---|---|---|---|---|
| Lubricating base oil[1)] | % by mass | balance | balance | balance | balance | balance |
| Nitrogen-containing compound[2)] | % by mass | 0.5 | 0.5 | — | — | — |
| Ashless FM[3)] | % by mass | — | — | 0.5 | — | — |
| Ashless dispersant[4)] | % by mass | 4.0 | 4.0 | 4.0 | 4.0 | 4.0 |
| Antioxidant[5)] | % by mass | 1.0 | 1.0 | 1.0 | 1.0 | 1.0 |
| Phosphorus compound A[6)] | % by mass | 0.57 | — | 0.57 | 0.57 | — |
| Phosphorus compound B[7)] | % by mass | — | 1.0 | — | — | 1.0 |
| Amount of the phosphorus compound in terms phosphorus | % by mass | 0.072 | 0.072 | 0.072 | 0.072 | 0.072 |
| Metallic detergent[8)] | % by mass | 3.0 | 3.0 | 3.0 | 3.0 | 3.0 |
| Other additives[9)] | % by mass | 3.0 | 3.0 | 3.0 | 3.0 | 3.0 |
| Sulfur content in the composition | % by mass | 0.01 | 0.15 | 0.01 | 0.01 | 0.15 |
| LFW-1 boundary friction test | speed mm/s | | | | | |
| Friction reduction rate to the | 1000 | 26.1 | 25.5 | 19.8 | 15.4 | 0 |
| criterion oil % | 750 | 26.9 | 26.6 | 20.0 | 15.8 | 0 |
| Load (average Hz pressure): | 500 | 27.1 | 27.2 | 19.9 | 15.5 | 0 |
| 100 lbs(299 MPa) | 200 | 29.0 | 29.5 | 20.8 | 14.8 | 0 |
| | 100 | 30.0 | 30.8 | 19.8 | 13.5 | 0 |
| | 50 | 32.2 | 32.7 | 20.2 | 12.5 | 0 |

[1)]hydrocracked mineral oil, kinematic viscosity at 100° C.: 4.7 $mm^2/s$, viscosity index: 120, total aromatic content: 1.2% by mass, sulfur content: 10 ppm by mass
[2)](A1) Oleyl semicarbazide represented by the formula below, nitrogen content: 12.8% by mass
[3)]glycerin monooleate
[4)]polybutenyl succinimide, nitrogen content 2.0% by mass, weight-average molecular weight: 4000
[5)]4,4'-methylene-bis-2,6-di-tert-butylphenol and alkyldiphenylamine
[6)]zinc dialkylphosphate, phosphorus content: 12.8% by mass, zinc content: 12.8% by mass, alkyl group: n-butyl
[7)]zinc dialkyldithiophosphate, phosphorus content: 7.2% by mass, alkyl group: sec-butyl or 4-methyl-2-pentyl
[8)]Ca salicylate, base number: 170 mgKOH/g, calcium content: 6% by mass
[9)]Additive containing viscosity index improvers (PMA,OCP), anti-foaming agent and the like C) 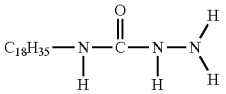

TABLE 2

| | | Example 3 | Example 4 | Reference Example 3 | Reference Example 4 | Reference Example 5 | Reference Example 6 | Criterion oil |
|---|---|---|---|---|---|---|---|---|
| Lubricating base oil[1)] | % by mass | balance | balance | balance | balance | balance | balance | balance |
| Nitrogen-containing compound[2)] | % by mass | 0.5 | 0.5 | — | — | — | — | — |
| Ashless FM-A[3)] | % by mass | — | — | 0.5 | 0.5 | — | — | — |
| Ashless FM-B[4)] | % by mass | — | — | — | — | 0.5 | 0.5 | — |
| Ashless dispersant[5)] | % by mass | 4.0 | 4.0 | 4.0 | 4.0 | 4.0 | 4.0 | 4.0 |
| Antioxidant[6)] | % by mass | 1.0 | 1.0 | 1.0 | 1.0 | 1.0 | 1.0 | 1.0 |
| Metal salt A[7)] | % by mass | 0.6 | — | 0.6 | — | 0.6 | — | — |
| Metal salt B[8)] | % by mass | — | 1.0 | — | 1.0 | — | 1.0 | 1.0 |
| Metallic detergent[9)] | % by mass | 3.0 | 3.0 | 3.0 | 3.0 | 3.0 | 3.0 | 3.0 |
| Other additives[10)] | % by mass | 3.0 | 3.0 | 3.0 | 3.0 | 3.0 | 3.0 | 3.0 |
| Phosphorus content | % by mass | 0.077 | 0.072 | 0.077 | 0.072 | 0.077 | 0.072 | 0.072 |
| Alkaline earth metal content | % by mass | 0.18 | 0.18 | 0.18 | 0.18 | 0.18 | 0.18 | 0.18 |
| Sulfur content | % by mass | 0.01 | 0.15 | 0.01 | 0.15 | 0.01 | 0.15 | 0.15 |
| LFW-1 boundary friction test | speed mm/s | | | | | | | |
| Friction reduction rate to the | 1000 | 27.4 | 28.9 | 19.8 | 6.9 | 19.2 | 17.8 | 0 |
| criterion oil % | 750 | 27.7 | 30.4 | 20.0 | 6.9 | 19.6. | 17.3 | 0 |
| Load (average Hz pressure): | 500 | 29.0 | 30.9 | 19.9 | 8.1 | 19.5 | 17.3 | 0 |
| 100 lbs(299 MPa) | 200 | 33.4 | 33.8 | 20.8 | 11.9 | 21.2 | 19.1 | 0 |
| | 100 | 37.8 | 36.2 | 19.8 | 12.8 | 21.3 | 19.7 | 0 |
| | 50 | 41.7 | 38.7 | 20.2 | 14.2 | 22.3 | 21.2 | 0 |

[1)]hydrocracked mineral oil, kinematic viscosity at 100° C.: 4.7 $mm^2/s$, viscosity index: 120, total aromatic content: 1.2% by mass, sulfur content:
[2)](A2) oleyl urea represented by the formula right, nitrogen content: 9% by mass
[3)]glycerin monooleate
[4)]oleylamine TABLE 2-continued

| | Example 3 | Example 4 | Reference Example 3 | Reference Example 4 | Reference Example 5 | Reference Example 6 | Criterion oil |
|---|---|---|---|---|---|---|---|

[5]polybutenyl succinimide, nitrogen content: 2.0% by mass, weight-average molecular weight: 3000
[6]4,4'-methylene-bis-2,6-di-tert-butylphenol and alkyldiphenylamine
[7]zinc dialkylphosphate, phosphorus content: 12.8% by mass, zinc content: 12.8% by mass, alkyl group: n-butyl
[8]mixture of zinc dialkyldithiophosphate, phosphorus content: 7.2% by mass, alkyl group: sec-butyl or 4-methyl-2-pentyl of one ZDTP and 2-ethylhexyl of the other ZDTP
[9]Ca salicylate, base number: 170 mgKOH/g, calcium content: 6% by mass
[10]Additive containing viscosity index improvers (PMA,OCP), anti-foaming agent and the like 2) 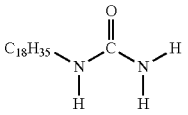

TABLE 3

| | | Example 5 | Reference Example 7 | Reference Example 8 | Criterion Oil |
|---|---|---|---|---|---|
| Lubricating base oil[1] | % by mass | balance | balance | balance | balance |
| Nitrogen-containing compound A[2] | % by mass | 0.5 | — | — | — |
| Ashless FM[3] | % by mass | — | — | 0.5 | — |
| Ashless dispersant[4] | % by mass | 4.0 | 4.0 | 4.0 | 4.0 |
| Antioxidant[5] | % by mass | 1.0 | 1.0 | 1.0 | 1.0 |
| Metal salt A[6] | % by mass | 0.6 | 0.6 | 0.6 | — |
| Metal salt B[7] | % by mass | — | — | — | 1.0 |
| Metallic detergent[8] | % by mass | 3.0 | 3.0 | 3.0 | 3.0 |
| Other additives[9] | % by mass | 3.0 | 3.0 | 3.0 | 3.0 |
| Phosphorus content | % by mass | 0.077 | 0.077 | 0.077 | 0.072 |
| Alkaline earth metal content | % by mass | 0.18 | 0.18 | 0.18 | 0.18 |
| Sulfur content | % by mass | 0.01 | 0.01 | 0.01 | 0.15 |
| LFW-1 boundary friction test | speed mm/s | | | | |
| Friction reduction rate to the criterion oil % | 1000 | 24.7 | 10.8 | 19.8 | 0 |
| Load (average Hz pressure): 299 MPa | 750 | 24.6 | 11.9 | 20.0 | 0 |
| | 500 | 25.1 | 12.9 | 19.9 | 0 |
| | 200 | 24.3 | 17.3 | 20.8 | 0 |
| | 100 | 29.6 | 17.9 | 19.8 | 0 |
| | 50 | 32.9 | 22.2 | 20.2 | 0 |

[1]hydrocracked mineral oil, kinematic viscosity at 100° C.: 4.7 $mm^2/s$,
viscosity index: 120,
total aromatic content: 1.2% by mass, sulfur content: 10 ppm by mass
[2](A3) oleyl ureid presented by the formula below, nitrogen content: 9% by mass
[3]glycerin monooleate
[4]polybutenyl succinimide, nitrogen content: 2.0% by mass, weight-average molecular weight: 3000
[5]4,4'-methylene-bis-2,6-di-tert-butylphenol and alkyldiphenylamine
[6]zinc dialkylphosphate, phosphorus content: 12.8% by mass,
zinc content: 12.8% by mass, alkyl group: n-butyl
[7]mixture of zinc dialkyldithiophosphate, phosphorus content: 7.2% by mass,
alkyl group: sec-butyl or 4-methyl-2-pentyl of one ZDTP and 2-ethylhexyl of the other ZDTP
[8]Ca salicylate, base number: 1 70 mgKOH/g, calcium content: 6% by mass
[9]Additive containing viscosity index improvers (PMA,OCP), anti-foaming agent and the like 2) 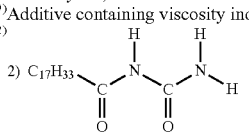

TABLE 4

| | | Example 6 | Reference Example 9 | Reference Example 10 | Reference Example 11 | Criterion Oil |
|---|---|---|---|---|---|---|
| Lubricating base oil[1] | % by mass | balance | balance | balance | balance | balance |
| Nitrogen-containing compound[2] | % by mass | 0.5 | — | — | — | — |
| Ashless FM-A[3] | % by mass | — | 0.5 | — | — | — |
| Ashless FM-B[4] | % by mass | — | — | 0.5 | — | — |
| Ashless dispersant[5] | % by mass | 4.0 | 4.0 | 4.0 | 4.0 | 4.0 |
| Antioxidant[6] | % by mass | 1.0 | 1.0 | 1.0 | 1.0 | 1.0 |
| Metal salt A[7] | % by mass | 0.6 | 0.6 | 0.6 | 0.6 | — |
| Metal salt B[8] | % by mass | — | — | — | — | 1.0 |
| Metallic detergent[9] | % by mass | 3.0 | 3.0 | 3.0 | 3.0 | 3.0 |

TABLE 4-continued

| | | Example 6 | Reference Example 9 | Reference Example 10 | Reference Example 11 | Criterion Oil |
|---|---|---|---|---|---|---|
| Other additives[10)] | % by mass | 3.0 | 3.0 | 3.0 | 3.0 | 3.0 |
| Phosphorus content | % by mass | 0.077 | 0.077 | 0.077 | 0.077 | 0.072 |
| Alkaline earth metal content | % by mass | 0.18 | 0.18 | 0.18 | 0.18 | 0.18 |
| Sulfur content | % by mass | 0.01 | 0.01 | 0.01 | 0.01 | 0.15 |
| LFW-1 boundary friction test | speed | | | | | |
| Friction reduction rate to the | mm/s | | | | | |
| criterion oil % | 1000 | 33.3 | 19.8 | 19.2 | 10.8 | 0 |
| Load (average Hz pressure): | 750 | 33.1 | 20.0 | 19.6 | 11.9 | 0 |
| 100 lbs(299 MPa) | 500 | 33.6 | 19.9 | 19.5 | 12.9 | 0 |
| | 200 | 33.9 | 20.8 | 21.2 | 17.3 | 0 |
| | 100 | 35.2 | 19.8 | 21.3 | 17.9 | 0 |
| | 50 | 37.0 | 20.2 | 22.3 | 22.2 | 0 |

1)hydrocracked mineral oil, kinematic viscosity at 100° C.: 4.7 $mm^2/s$, viscosity index: 120, total aromatic content: 1.2% by mass, sulfur content: 10 ppm by mass
2)(A4) oleyl allophanamide represented by the formula below, nitrogen content: 9% by mass
3)glycerin monooleate
4)oleylamine
5)polybutenyl succinimide, nitrogen content: 2.0% by mass, weight-average molecular weight: 3000
6)4,4'-methylene-bis-2,6-di-tert-butylphenol and alkyldiphenylamine
7)zinc dialkylphosphate, phosphorus content: 12.8% by mass, zinc content: 12.8% by mass, alkyl group: n-butyl
8)mixture of zinodialkyl dithiophosphate, phosphorus content 7.2% by mass, alkyl group: sec-butyl or 4-methyl-2-pentyl
of one ZDTP and 2-ethylhexyl of the other ZDTP
9)Ca salicylate, base number 170 mgKOH/g, calcium content: 6% by mass
10)Additive containing viscosity index improvers (PMA,OCP), anti-foaming agent and the like 2) 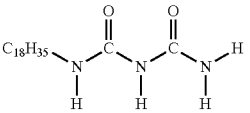

TABLE 5

| | | Examples | | | | | | | |
|---|---|---|---|---|---|---|---|---|---|
| | | 22 | 23 | 24 | 25 | 26 | 27 | 28 | 29 |
| Hydro-refined mineral oil[1)] | % by mass | balance | balance | balance | balance | balance | balance | balance | balance |
| (A6) Oil soluble metal complex 1 | % by mass | 1.6 | — | — | — | — | — | — | — |
| (A6) Oil soluble metal complex 2 | % by mass | — | 2 | — | — | — | — | — | — |
| (A6) Oil soluble metal complex 3 | % by mass | — | — | 3 | — | — | — | — | — |
| (A6) Oil soluble metal complex 4 | % by mass | — | — | — | 3 | — | — | — | — |
| (A6) Oil soluble metal complex 5 | % by mass | — | — | — | — | 6.5 | — | — | — |
| (A6) Oil soluble metal complex 6 | % by mass | — | — | — | — | — | 6.5 | — | — |
| (A6) Oil soluble metal complex 7 | % by mass | — | — | — | — | — | — | 6.5 | — |
| (A6) Oil soluble metal complex 8 | % by mass | — | — | — | — | — | — | — | 2.5 |
| (A6) Oil soluble metal complex 9 | % by mass | — | — | — | — | — | — | — | — |
| (A6) Oil soluble metal complex 10 | % by mass | — | — | — | — | — | — | — | — |
| (A6) Oil soluble metal complex 11 | % by mass | — | — | — | — | — | — | — | — |
| (A6) Oil soluble metal complex 12 | % by mass | — | — | — | — | — | — | — | — |
| (A6) Oil soluble metal complex 13 | % by mass | — | — | — | — | — | — | — | — |
| (A6) Oil soluble metal complex 14 | % by mass | — | — | — | — | — | — | — | — |
| (A6) Oil soluble metal complex 15 | % by mass | — | — | — | — | — | — | — | — |
| Viscosity index improver[2)] | % by mass | — | — | — | — | — | — | — | — |
| Solubility Test (40° C.) | After 0.5 hour | no | no | no | no | no | no | no | no |
| Whether insolubles are present or | After 1 hour | no | no | no | no | no | no | no | no |
| not | After 5 hours | no | no | no | no | no | no | no | no |
| | After 10 hours | no | no | no | no | no | no | no | no |

| | | Examples | | | | | | |
|---|---|---|---|---|---|---|---|---|
| | | 30 | 31 | 32 | 33 | 34 | 35 | 36 |
| Hydro-refined mineral oil[1)] | % by mass | balance | balance | balance | balance | balance | balance | balance |
| (A6) Oil soluble metal complex 1 | % by mass | — | — | — | — | — | — | — |
| (A6) Oil soluble metal complex 2 | % by mass | — | — | — | — | — | — | — |
| (A6) Oil soluble metal complex 3 | % by mass | — | — | — | — | — | — | — |
| (A6) Oil soluble metal complex 4 | % by mass | — | — | — | — | — | — | — |
| (A6) Oil soluble metal complex 5 | % by mass | — | — | — | — | — | — | — |
| (A6) Oil soluble metal complex 6 | % by mass | — | — | — | — | — | — | — |
| (A6) Oil soluble metal complex 7 | % by mass | — | — | — | — | — | — | — |
| (A6) Oil soluble metal complex 8 | % by mass | — | — | — | — | — | — | — |
| (A6) Oil soluble metal complex 9 | % by mass | 3 | — | — | — | — | — | — |

TABLE 5-continued

| | | | | | | | | |
|---|---|---|---|---|---|---|---|---|
| (A6) Oil soluble metal complex 10 | % by mass | — | 3 | — | — | — | — | — |
| (A6) Oil soluble metal complex 11 | % by mass | — | — | 3 | — | — | — | — |
| (A6) Oil soluble metal complex 12 | % by mass | — | — | — | 5.5 | — | — | — |
| (A6) Oil soluble metal complex 13 | % by mass | — | — | — | — | 5.5 | — | — |
| (A6) Oil soluble metal complex 14 | % by mass | — | — | — | — | — | 6.5 | — |
| (A6) Oil soluble metal complex 15 | % by mass | — | — | — | — | — | — | 10.1 |
| Viscosity index improver[2)] | % by mass | — | — | — | — | — | — | 3 |
| Solubility Test (40° C.) | After 0.5 hour | no | no | no | no | no | no | no |
| Whether insolubles are present or not | After 1 hour | no | no | no | no | no | no | no |
| | After 5 hours | no | no | no | no | no | no | no |
| | After 10 hours | no | no | no | no | no | no | no |

[1)]kinematic viscosity @100° C.: 5.6 $mm^2/s$, viscosity index: 120, total aromatics: 1.2 mass %, sulfur content: 0.001 mass %

[2)]olefin copolymer-type viscosity index improver, weight-average molecular weight: 150,000

TABLE 6

| | | Reference Examples | | | | | | | |
|---|---|---|---|---|---|---|---|---|---|
| | | 12 | 13 | 14 | 15 | 16 | 17 | 18 | 19 |
| Hydro-refined mineral oil[1)] | % by mass | balance | balance | balance | balance | balance | balance | balance | balance |
| Solvent-refined mineral oil[2)] | % by mass | — | — | — | 1 | 1 | 1 | 1 | — |
| (a) Hydrazide delivative[3)] | % by mass | 0.5 | 0.5 | 0.5 | 0.5 | 0.5 | 0.5 | 0.5 | — |
| (a) Semicarbazide delivative[4)] | % by mass | — | — | — | — | — | — | — | 0.5 |
| (b) Metal salt A[5)] | % by mass | 1.1 | — | — | — | — | — | — | 1.1 |
| (b) Metal salt B[6)] | % by mass | — | 1 | 1 | — | 1 | — | — | — |
| (b) Metal salt C[7)] | % by mass | — | — | — | — | — | — | 1 | — |
| (b) Metal salt D[8)] | % by mass | — | — | — | — | — | 1 | — | — |
| (b) Metal salt E[9)] | % by mass | — | — | — | 1 | — | — | — | — |
| (c) Amine compound A[10)] | % by mass | — | — | 0.5 | 0.5 | — | — | — | — |
| (c) Amine compound B[11)] | % by mass | — | 0.5 | — | — | — | — | — | — |
| (c) Amine compound C[12)] | % by mass | — | — | — | — | 4 | 4 | 4 | — |
| Metallic detergent[13)] | % by mass | — | — | — | — | — | — | — | — |
| Antioxidant A[14)] | % by mass | — | — | 0.5 | — | — | — | — | — |
| Antioxidant B[15)] | % by mass | — | — | — | — | — | — | — | — |
| Viscosity index improver[16)] | % by mass | — | — | — | — | — | — | — | — |
| Solubility Test | After 0.5 hour | yes | yes | yes | yes | yes | yes | yes | yes |
| Whether insolubles are present or not | After 1 hour | yes | yes | yes | yes | yes | yes | yes | yes |
| | After 5 hours | yes | yes | yes | yes | yes | yes | yes | yes |
| | After 10 hours | yes | yes | yes | yes | yes | yes | yes | yes |

| | | Reference Examples | | | | | | |
|---|---|---|---|---|---|---|---|---|
| | | 20 | 21 | 22 | 23 | 24 | 25 | 26 |
| Hydro-refined mineral oil[1)] | % by mass | balance | balance | balance | balance | balance | balance | balance |
| Solvent-refined mineral oil[2)] | % by mass | — | 1 | 1 | — | — | 1 | — |
| (a) Hydrazide delivative[3)] | % by mass | — | — | — | — | — | — | — |
| (a) Semicarbazide delivative[4)] | % by mass | 0.5 | 0.5 | 0.5 | 0.5 | 0.5 | 0.5 | 0.5 |
| (b) Metal salt A[5)] | % by mass | — | — | — | — | — | — | — |
| (b) Metal salt B[6)] | % by mass | 1 | 1 | — | 1 | — | — | 0.6 |
| (b) Metal salt C[7)] | % by mass | — | — | — | — | — | — | — |
| (b) Metal salt D[8)] | % by mass | — | — | — | — | 1 | 1 | — |
| (b) Metal salt E[9)] | % by mass | — | — | 1 | — | — | — | — |
| (c) Amine compound A[10)] | % by mass | — | 0.5 | 0.5 | — | — | — | — |
| (c) Amine compound B[11)] | % by mass | 0.5 | — | | — | — | — | — |
| (c) Amine compound C[12)] | % by mass | — | — | — | 4 | 4 | 4 | 4 |
| Metallic detergent[13)] | % by mass | — | — | — | — | — | — | 3 |
| Antioxidant A[14)] | % by mass | 1 | — | — | — | — | — | 1 |
| Antioxidant B[15)] | % by mass | — | — | — | — | — | — | 1 |
| Viscosity index improver[16)] | % by mass | — | — | — | — | — | — | 3 |
| Solubility Test | After 0.5 hour | yes | yes | yes | yes | yes | yes | yes |
| Whether insolubles are present or not | After 1 hour | yes | yes | yes | yes | yes | yes | yes |
| | After 5 hours | yes | yes | yes | yes | yes | yes | yes |
| | After 10 hours | yes | yes | yes | yes | yes | yes | yes |

[1)]kinematic viscosity at 100° C.: 5.6 $mm^2/s$, viscosity index: 120, total aromatic content: 1.2% by mass, sulfur content: 0.001% by mass

[2)]kinematic viscosity at 100° C.: 5.45 $mm^2/s$, viscosity index: 100, total aromaticcontent: 20% by mass, sulfur content: 0.13% by mass

[3)](A7) oleic hydrazide, nitrogen content: 9.4% by mass

[4)](A1) oleyl semicarbazide, nitrogen content: 12.8% by mass

[5)]zinc di(2-ethylhexyl)dithiophosphate, phosphorus content: 7.2% by mass, zinc content: 9.1% by mass

[6)]zinc dibutylphosphate, phosphorus content: 12.8% by mass, zinc content: 12.8% by mass, sulfur content: 0% by mass

[7)]zinc salt of 2-ethylhexylphosphonic acid mono(2-ethylhexyl)ester, phosphorus content: 9.5% by mass, zinc content: 9.2% by mass

[8)]zinc naphthenate, zinc content: 9.1% by mass

[9)]zinc di(2-ethylhexyl)dithiocarbamate, zinc content: 9.1% by mass

[10)]oleyl amine, nitrogen content: 5.1% by mass

[11)]dodecyl N, Ndimethylamine, nitrogen content: 6.6% by mass

TABLE 6-continued

[12]polybutenyl succinimide, number-average molecular weight of PIB group: 1000, nitrogen content: 2.0% by mass, boron content: 0.5% by mass

[13]calcium salicylate, base number: 170 mgKOH/g, calcium content: 6.1% by mass

[14]alkyldiphenylamine

[15]octyl-3-(3,5-di-tert-butyl-4-hydroxyphenyl)propionate

[16]olefin copolymer-type viscosity index improver, weight-average molecular weight: 150,000

TABLE 7

| | | Example 37 | Reference Example 27 | Reference Example 28 | Reference Example 29 | Criterion Oil |
|---|---|---|---|---|---|---|
| Lubricating base oil[1] | % by mass | balance | balance | balance | balance | balance |
| Nitrogen-containing compound[2] | % by mass | 0.5 | 0.5 | — | — | — |
| Ashless FM[3] | % by mass | — | — | 0.5 | 0.5 | — |
| Phosphorus compound A[4] | % by mass | 0.6 | — | 0.6 | — | — |
| Phosphorus compound B[5] | % by mass | — | 1.0 | — | 1.0 | 1.0 |
| Amount of the phosphorus compound in terms of phosphorus | % by mass | (0.077) | (0.072) | (0.077) | (0.072) | (0.072) |
| Ashless dispersant[6] | % by mass | 4.0 | 4.0 | 4.0 | 4.0 | 4.0 |
| Antioxidant[7] | % by mass | 2.0 | 2.0 | 2.0 | 2.0 | 2.0 |
| Metallic detergent[8] | % by mass | 3.0 | 3.0 | 3.0 | 3.0 | 3.0 |
| Other additives[9] | % by mass | 3.0 | 3.0 | 3.0 | 3.0 | 3.0 |
| Amount of the sulfur-containing anti-wear agent in terms of sulfur | % by mass | 0.0 | 0.14 | 0.0 | 0.14 | 0.14 |
| LFW-1 boundary friction test | speed | | | | | |
| Friction reduction rate to the | mm/s | | | | | |
| criterion oil % | 1000 | 27.9 | 11.6 | 25.0 | 13.9 | 0 |
| Load (average Hz pressure): | 750 | 27.9 | 12.2 | 25.6 | 15.4 | 0 |
| 100 lbs(299 MPa) | 500 | 27.8 | 15.4 | 25.9 | 18.4 | 0 |

[1]hydrocracked mineral oil, kinematic viscosity at 100° C.: 4.7 $mm^2/s$, viscosity index: 120, total aromatic content: 1.2% by mass, sulfur content: 10 ppm by mass

[2](A7) erucahydrazide represented by the formula below, nitrogen content: 8% by mass

[3]erucamide

[4]zinc dialkylphosphate, phosphorus content 12.8% by mass, zinc content: 12.8% by mass, alkyl group: n-butyl

[5]zinc dialkyldithiophosphate, phosphorus content: 7.2% by mass, alkyl group: sec-butyl or 4-methyl-2-pentyl

[6]polybutenyl succinimide, nitrogen content: 2.0% by mass, weight-average molecular weight: 4,000

[7]4,4'-methylene-bis-2,6-di-tert-butylphenol and alkyldiphenylamine

[8]Ca salicylate, base number: 170 mgKOH/g, calcium content: 6% by mass

[9]Additive containing viscosity index improvers (PMA,OCP), anti-foaming agent and the like 2) 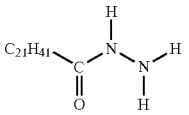

TABLE 8

| | | Example 38 | Reference Example 30 | Example 39 | Example 40 | Criterion Oil |
|---|---|---|---|---|---|---|
| Lubricating base oil[1] | % by mass | balance | balance | balance | balance | balance |
| Phosphorus compound A[2] | % by mass | 0.3 | 0.3 | — | 0.3 | — |
| Phosphorus compound B[3] | % by mass | 0.4 | 0.4 | 0.6 | — | — |
| nitrogen-containing compound[4] | % by mass | 0.5 | — | 0.5 | 0.5 | — |
| Ashless dispersant[5] | % by mass | 4.0 | 4.0 | 4.0 | 4.0 | 4.0 |
| Metallic detergent[6] | % by mass | 3.0 | 3.0 | 3.0 | 3.0 | 3.0 |
| Antioxidant[7] | % by mass | 2.0 | 2.0 | 2.0 | 2.0 | 2.0 |
| ZDTP[8] | % by mass | — | — | — | — | 1.0 |
| Other additives[9] | % by mass | 3.0 | 3.0 | 3.0 | 3.0 | 3.0 |
| Phosphorus content | % by mass | 0.077 | 0.077 | 0.077 | 0.025 | 0.072 |
| Ca content | % by mass | 0.18 | 0.18 | 0.18 | 0.18 | 0.18 |
| S content | % by mass | 0.01 | 0.01 | 0.01 | 0.01 | 0.15 |
| High-speed four-ball test LNSL | N | 985 | 785 | 490 | 618.00 | — |
| LFW-1 boundary friction test | speed | | | | | |
| Friction reduction rate to the | mm/s | | | | | |
| criterion oil % | 1000 | 25.5 | 18.8 | 23.6 | 23.5 | 0 |
| Load (average Hz pressure): | 750 | 26.2 | 19.0 | 23.9 | 24.0 | 0 |

TABLE 8-continued

| | | Example 38 | Reference Example 30 | Example 39 | Example 40 | Criterion Oil |
|---|---|---|---|---|---|---|
| 100 lbs(299 MPa) | 500 | 27.0 | 19.2 | 24.8 | 24.9 | 0 |
| | 200 | 32.6 | 23.8 | 29.8 | 30.5 | 0 |
| | 100 | 35.9 | 25.4 | 32.5 | 33.6 | 0 |
| | 50 | 39.8 | 29.1 | 36.5 | 37.1 | 0 |

1)hydrocracked mineral oil, kinematic viscosity at 100° C.: 4.7 $mm^2/s$, viscosity index: 120, total aromatics: 1.2% by mass, sulfur content: 10 ppm by mass 2)octadecylphosphonic acid dimethyl ester represented by the formula below, phosphorus content 8.6% by mass 3)zinc salt of di-n-butylphosphate represented by the formula below, phosphorus content: 12.8% by mass 4)(A7) oleic hydrazide represented by the formula below 5)polybutenyl succinimide, nitrogen content: 2.0% by mass, weight-average molecular weight: 3,000

6)Ca salicylate, base number: 170 mgKOH/g, calcium content: 6% by mass 7)4,4'-methylene-bis-2,6-di-tert-butylphenol and alkyldiphenylamine mixture of ZDTP having sec-butyl group or 4-methyl-2-pentyl group and ZDTP having 2-ethylhexyl group, phosphorus content: 7.2% by mass 9)Additive containing viscosity index improvers (PMA,OCP), anti-foaming agent and the like 2) 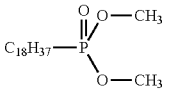

3) 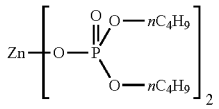

4) 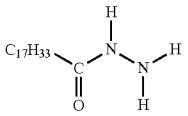

TABLE 9

| | | Example 41 | Example 42 |
|---|---|---|---|
| Lubricating base oil1) | mass % | balance | balance |
| Acid-modified derivative of nitrogen-containing compound A2) | mass % | 0.3 | — |
| Nitrogen-containing compound A3) | mass % | — | 0.3 |
| Anti-wear agent4) | mass % | 0.55 | 0.55 |
| Ashless dispersant5) | mass % | 4.0 | 4.0 |
| Antioxidant6) | mass % | 1.0 | 1.0 |
| Metallic detergent7) | mass % | 3.5 | 3.5 |
| Other additives8) | mass % | 0.6 | 0.6 |
| Base number in the composition (hydrochloric acid method) | mgKOH/g | 6.65 | 6.63 |
| Base number in the composition (perchloric acid method) | mgKOH/g | 11.2 | 11.2 |
| Element consentration in the composition | | | |
| B | mass % | 0.01 | <0.001 |
| Ca | mass % | 0.20 | 0.20 |
| P | mass % | 0.072 | 0.072 |
| Zn | mass % | 0.08 | 0.08 |
| S | mass % | 0.01 | 0.01 |
| N | mass % | 0.153 | 0.158 |
| Amount of copper elusion after 96 hours of ISOT at 165.5° C. | mass ppm | 8 | 35 |
| Base number (HCL) remaining rate after 96 hours of ISOT at 165.5° C. | % | 45 | 42 |

TABLE 9-continued

| | | Example 41 | Example 42 |
|---|---|---|---|
| Hot tube test 310° C. | grade | 8 | 5 |
| Cam nose average wear (JASO M328-95, 100 hours) | μm | 2 | 15 |

[1]hydrocracked mineral oil, kinematic viscosity at 100° C.: 4.7 $mm^2/s$, viscosity index: 120, total aromatic content: 1.2% by mass, sulfur content: 10 ppm by mass
[2](AS) boric acid-modified derivative of oleic hydrazide (oleic hydrazide one mole: boric acid one mole), nitrogen content: 7.8% by mass, boron content: 3.0% by mass
[3](A7) oleic hydrazide represented by the formula below, nitrogen content: 9.4% by mass
[4]zinc dialkylphosphate wherein the alkyl group is n-butyl, phosphorus content: 12.8% by mass
[5]polybutenyl succinimide, nitrogen content: 2.0% by mass, weight-average molecular weight: 3,000
[6]4,4'-methylene-bis-2,6-di-tert-butylphenol and alkyldiphenylamine
[7]a mixture of Ca salicylate with a base number: 170 mgKOH/g, calcium content: 6% by mass and Ca salicylate with a base number 60mgKOH/g and calcium content: 2% by mass
[8]Additive containing viscosity index improvers (PMA,OCP), anti-foaming agent and the like 3) 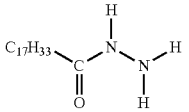

What is claimed is:

1. An internal combustion engine comprising a lubricating oil composition comprising a lubricating base oil and a lubricating additive, wherein the lubricating additive comprises (A) one or more compounds selected from the group consisting of the following (A-1) through (A-6) components:

(A-1) at least one kind of compound selected from the group consisting of nitrogen-containing compounds represented by formula (2) below and acid-modified derivatives thereof:

(2)

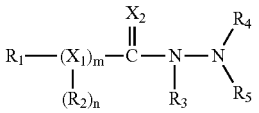

wherein $R_1$ is a hydrocarbon or functionalized hydrocarbon group having 1 to 30 carbon atoms, $R_2$, $R_4$ and $R_5$ are each independently a hydrocarbon or functionalized hydrocarbon group having 1 to 10 carbon atoms or hydrogen, $R_3$ is a hydrogen, $X_1$ is selected from oxygen, nitrogen, and sulfur, $X_2$ is oxygen, m is an integer of 1 or 2, and n is an integer of 0 or 1;

(A-2) at least one kind of compound selected from the group consisting of acid-modified derivatives of nitrogen-containing compounds represented by formula (3) below:

(3)

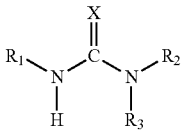

wherein $R_1$ is a hydrocarbon or functionalized hydrocarbon group having 1 to 30 carbon atoms, $R_2$ and $R_3$ are each independently a hydrocarbon or functionalized hydrocarbon group having 1 to 30 carbon atoms or hydrogen, and X is oxygen or sulfur;

(A-3) at least one kind of compound selected from the group consisting of nitrogen-containing compounds represented by formula (4) below and acid-modified derivatives thereof:

(4)

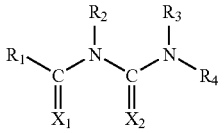

wherein $R_1$ is a hydrocarbon or functionalized hydrocarbon group having 1 to 30 carbon atoms, $R_2$ through $R_4$ are each independently a hydrocarbon or functionalized hydrocarbon group having 1 to 30 carbon atoms or hydrogen, and $X_1$ and $X_2$ are each independently oxygen or sulfur;

(A-4) at least one kind of compound selected from the group consisting of nitrogen-containing compounds represented by formula (5) below and acid-modified derivatives thereof:

(5)

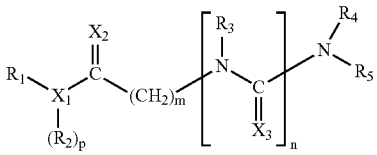

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 30 carbon atoms or hydrogen, $X_1$ is oxygen or nitrogen, $X_2$ and $X_3$ are each independently oxygen or sulfur, p is an integer of 0 or 1, m is an integer of 0 or 1, and n is an integer of 1 or greater;

(A-5) hydrazide derivatives obtained by modifying nitrogen-containing compounds represented by formula (6) below with phosphoric acid or a salt thereof and an organic metal salt and/or an organic metal complex:

(6)

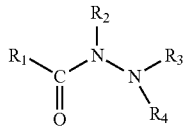

wherein $R_1$ is a hydrocarbon group having 1 to 30 carbon atoms or a functionalized substituent having 1 to 30 carbon atoms and $R_2$ through $R_4$ are each independently a hydrocarbon group having 1 to 30 carbon atoms a functionalized substituent having 1 to 30 carbon atoms or hydrogen; and (A-6) oil soluble metal complexes obtained by mixing at least one kind of compound selected from the group consisting of Components (A-1) through) (A-5) and nitrogen-containing compounds represented by formula (7) below with an organic metal salt and/or an organic metal complex:

(7)

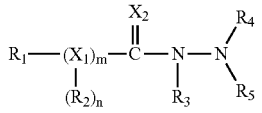

wherein $R_1$ is a hydrocarbon or functionalized hydrocarbon group having 1 to 30 carbon atoms, $R_2$, $R_4$ and $R_5$ are each independently a hydrocarbon or functionalized hydrocarbon group having 1 to 30 carbon atoms or hydrogen, $R_3$ is a hydrogen, $X_1$ is selected from oxygen, nitrogen and sulfur, $X_2$ is oxygen or sulfur, m is an integer of 0 to 2, and n is an integer of 0 or 1.

2. The internal combustion engine according to claim 1 wherein a fuel for the internal combustion engines has a sulfur content of 50 ppm by mass or less.

3. The internal combustion engine according to claim 1 wherein the internal combustion engines is equipped with a direct striking bucket type- or roller follower-type valve train system.

4. The internal combustion engine according to claim 1 wherein the internal combustion engines is equipped with an exhaust gas treatment system which is a combustion of one or more kinds selected from the group consisting of a ternary catalyst, an oxidation catalyst, a NOx adsorber and a DPF.

5. A lubricating oil additive comprising oil soluble metal complexes which comprise one or more compounds selected from the group consisting of (A-2) nitrogen-containing compounds represented by formula (3) below, and an organic metal salt and/or an organic metal complex:

(3)

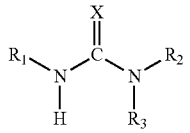

wherein $R_1$ is a hydrocarbon or functionalized hydrocarbon group having 1 to 30 carbon atoms, $R_2$ and $R_3$ are each independently a hydrocarbon or functionalized hydrocarbon group having 1 to 30 carbon atoms or hydrogen and X is oxygen or sulfur.

6. A lubricating oil composition comprising a lubricating base oil, (C) a phosphorus compound other than zinc dithiophosphate, and at least one lubricating oil additive selected from the group consisting of the lubricating oil additive according to claim 5, a lubricating oil additive comprising nitrogen-containing compounds represented by formula (3) below, a lubricating oil additive comprising nitrogen-containing compounds represented by formula (6) below, hydrazide derivatives obtained by modifying nitrogen-containing compounds represented by formula (6) with carboxylic acid or a salt thereof, and a lubricating oil additive comprising oil soluble metal complexes which comprise hydrazide derivatives obtained by modifying nitrogen-containing compounds represented by formula (6) with carboxylic acid or a salt thereof and an organic metal salt and/or an organic metal complex:

(3)

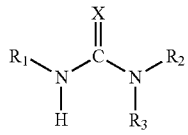

wherein $R_1$ is a hydrocarbon or functionalized hydrocarbon group having 1 to 30 carbon atoms, $R_2$ and $R_3$ are each independently a hydrocarbon or functionalized hydrocarbon group having 1 to 30 carbon atoms or hydrogen, and X is oxygen or sulfur; and (6)

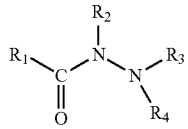

wherein $R_1$ is a hydrocarbon group having 1 to 30 carbon atoms or a functionalized substituent having 1 to 30 carbon atoms and $R_2$ through $R_4$ are each independently a hydrocarbon group having 1 to 30 carbon atoms, a functionalized substituent having 1 to 30 carbon atoms, or hydrogen.

7. The lubricating oil composition according to claim 6 wherein Component (C) is at least one kind of compound selected from the group consisting of (C-1) phosphorus compounds represented by formula (8) below and metal salts and amine salts thereof:

(8)

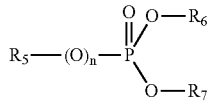

wherein $R_5$ is a hydrocarbon group which may contain oxygen and/or nitrogen, having 1 to 30 carbon atoms, $R_6$ and $R_7$ are each independently a hydrocarbon group which may contain oxygen and/or nitrogen, having 1 to 30 carbon atoms or hydrogen, and n is an integer of 0 or 1.

8. The lubricating oil composition according to claim 6 wherein Component (C) is at least one kind of compound selected from the group consisting of (C-2) phosphorus compounds represented by formula (9) below and/or (C-3) metal salts of phosphorus compounds represented by formulas (10) and (11) below:

(9)

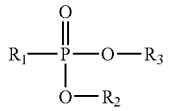

wherein $R_1$, $R_2$ and $R_3$ are each independently a hydrocarbon group which may contain oxygen and/or nitrogen, having 1 to 30 carbon atoms;

(10)

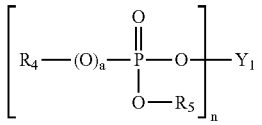

wherein $R_4$ and $R_5$ are each independently a hydrocarbon group which may contain nitrogen and/or oxygen, having 3 to 30 carbon atoms, Y, is a metal element, n is an integer corresponding to the valence of $Y_1$, and a is integer of 0 or 1; and (11)

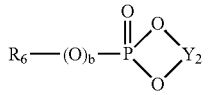

wherein $R_6$ is a hydrocarbon group which may contain oxygen and/or nitrogen, having 3 to 30 carbon atoms, $Y_2$ is a metal element, and b is an integer of 0 or 1.

9. A lubricating oil additive comprising (A) one or more compounds selected from the group consisting of the following (A-1) through (A-6) components:

(A-1) a derivative obtained by modifying nitrogen-containing compounds represented by formula (2) below with boric acid or a salt thereof:

(2)

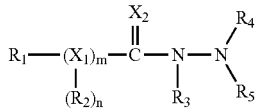

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 10 carbon atoms or hydrogen, $X_1$ is selected from oxygen, nitrogen, and sulfur, $X_2$ is oxygen or sulfur, m is an integer of 1 or 2, and n is an integer of 0 or 1;

(A-2) a derivative obtained by modifying nitrogen-containing compounds represented by formula (3) below with boric acid or a salt thereof:

(3)

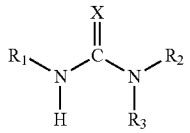

wherein $R_1$ is a hydrocarbon or functionalized hydrocarbon group having 1 to 30 carbon atoms, $R_2$ and $R_3$ are each independently a hydrocarbon or functionalized hydrocarbon group having 1 to 30 carbon atoms or hydrogen, and X is oxygen or sulfur;

(A-3) a derivative obtained by modifying nitrogen-containing compounds represented by formula (4) below with boric acid or a salt thereof:

(4)

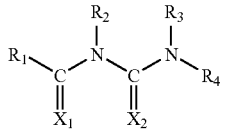

wherein $R_1$ is a hydrocarbon or functionalized hydrocarbon group having 1 to 30 carbon atoms, $R_2$ through $R_4$ are each independently a hydrocarbon or functionalized hydrocarbon group having 1 to 30 carbon atoms or hydrogen, and $X_1$ and $X_2$ are each independently oxygen or sulfur;

(A-4) a derivative obtained by modifying nitrogen-containing compounds represented by formula (5) below with boric acid or a salt thereof:

(5)

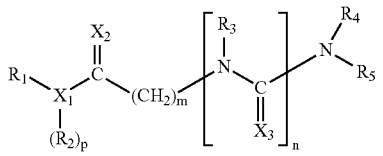

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 30 carbon atoms or hydrogen, $X_1$ is oxygen or nitrogen, $X_2$ and $X_3$ are each independently oxygen or sulfur, p is an integer of 0 or 1, m is an integer of 0 or 1, and n is an integer of 1 or greater;

(A-5) a hydrazide derivative obtained by modifying nitrogen-containing compounds represented by formula (6) below with boric acid or a salt thereof:

(6)

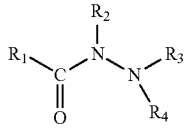

wherein $R_1$ is a hydrocarbon group having 1 to 30 carbon atoms or a functionalized substituent having 1 to 30 carbon atoms, $R_2$ through $R_4$ are each independently a hydrocarbon group having 1 to 30 carbon atoms, a functionalized substituent having 1 to 30 carbon atoms, or hydrogen; and (A-6) oil soluble metal complexes comprising at least one compound selected from the group consisting of Components (A-1) through (A-5) and a derivative obtained by modifying nitrogen-containing compounds represented by formula (7) below with boric acid or a salt thereof, and an organic metal salt and/or an organic metal complex:

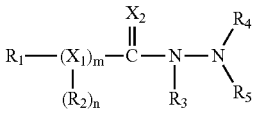

(7)

wherein $R_1$ is a hydrocarbon or functionalized hydrocarbon group having 1 to 30 carbon atoms, $R_2$ through $R_5$ are each independently a hydrocarbon or functionalized hydrocarbon group having 1 to 30 carbon atoms or hydrogen, $X_1$ is selected from oxygen, nitrogen and sulfur, $X_2$ is oxygen or sulfur, m is an integer of 0 to 2, and n is an integer of 0 or 1.

10. A lubricating oil composition comprising a lubricating base oil and the lubricating oil additive according to claim 9.

11. The lubricating oil composition according to claim 10 wherein the composition further comprises (B) a metal-containing phosphorus compound.

12. The lubricating oil composition according to claim 10 wherein the composition further comprises (C) a phosphorus compound other than zinc dithiophosphate.

13. The lubricating oil composition according claim 11 wherein the composition further comprises at least one additive selected from the group consisting of ashless dispersants, antioxidants, friction modifiers, anti-wear agents other than a phosphorus compound, metallic detergents, viscosity index improvers, corrosion inhibitors, rust inhibitors, demulsifiers, metal deactivators, anti-forming agents, seal swelling agents, and dyes.

14. The lubricating oil composition according claim 12 wherein the composition further comprises at least one additive selected from the group consisting of ashless dispersants, antioxidants, friction modifiers, anti-wear agents other than a phosphorus compound, metallic detergents, viscosity index improvers, corrosion inhibitors, rust inhibitors, demulsifiers, metal deactivators, anti-forming agents, seal swelling agents, and dyes.

* * * * *